US012195230B2

(12) United States Patent
Davidian et al.

(10) Patent No.: US 12,195,230 B2
(45) Date of Patent: Jan. 14, 2025

(54) STACKABLE STORAGE SYSTEM

(71) Applicant: TECHTRONIC CORDLESS GP, Anderson, SC (US)

(72) Inventors: Richard M. Davidian, Pickens, SC (US); Rony Chan, Simpsonville, SC (US); William J. Saunders, Anderson, SC (US); Ryan A. Hirtz, Pelzer, SC (US); Tyler H. Knight, Greenville, SC (US); Drew A. Dahill, Pendleton, SC (US); Austin Clark, Seneca, SC (US); Stephen A. Hughett, Anderson, SC (US); J. Luke Jenkins, Williamston, SC (US); J. Mike King, Inman, SC (US); Jeffrey Groves, Greenville, SC (US); J. Porter Whitmire, Greenville, SC (US); Brianna E. Williams, Greenville, SC (US); Charles Moody Wacker, II, Anderson, SC (US)

(73) Assignee: TECHTRONIC CORDLESS GP, Anderson, SC (US)

( * ) Notice: Subject to any disclaimer, the term of this patent is extended or adjusted under 35 U.S.C. 154(b) by 628 days.

(21) Appl. No.: 17/153,251

(22) Filed: Jan. 20, 2021

(65) Prior Publication Data

US 2021/0221561 A1 Jul. 22, 2021

Related U.S. Application Data

(60) Provisional application No. 63/070,633, filed on Aug. 26, 2020, provisional application No. 63/030,694,
(Continued)

(51) Int. Cl.
*B65D 21/02* (2006.01)
*B65D 43/16* (2006.01)

(52) U.S. Cl.
CPC ..... *B65D 21/0223* (2013.01); *B65D 21/0224* (2013.01); *B65D 43/163* (2013.01)

(58) Field of Classification Search
CPC ..... B65D 43/163; B65D 21/0224; B65D 21/0223; B65D 2525/288; B65D 21/02; B25H 3/02
(Continued)

(56) References Cited

U.S. PATENT DOCUMENTS 2,541,828 A 2/1951 Peck
2,695,105 A 11/1954 Mitchell
(Continued)

FOREIGN PATENT DOCUMENTS

AU 2015101015 B4 9/2015
CA 2960449 A1 3/2016
(Continued)

OTHER PUBLICATIONS

Home Depot, "Ryobi Link Standard Tool Box", First reviewed Dec. 14, 2021. (https:/www.homedepot.com/p/RYOBI-LINK-Standard-Tool-BOX-STM101/317036936) (Year: 2021).
(Continued)

*Primary Examiner* — Ernesto A Grano
(74) *Attorney, Agent, or Firm* — Dority & Manning, P.A.

(57) ABSTRACT

A stackable storage system includes a first container, a second container, and a latch moveable between a first position and a second position. The first container includes a projection extending away from the first container along a stacking direction. An edge portion extends from the projection along a plane substantially perpendicular to the stacking direction. The second container includes a recess. The recess receives the projection when the first container and the second container are stacked relative to one another in the stacking direction. The latch overlaps the edge portion
(Continued)

with respect to the stacking direction while in the first position to secure the first container and the second container. The latch and edge portion are positioned in a non-overlapping manner relative to one another while the latch is in the second position to permit separation of the first container from the second container.

23 Claims, 25 Drawing Sheets

Related U.S. Application Data filed on May 27, 2020, provisional application No. 62/963,234, filed on Jan. 20, 2020.

(58) Field of Classification Search
USPC ..... 206/425
See application file for complete search history.

(56) References Cited

U.S. PATENT DOCUMENTS 3,504,405 A 4/1970 Elliott-Smith
4,119,285 A 10/1978 Bisping et al.
4,351,448 A * 9/1982 Ingersoll ..... A45C 13/28 206/508
4,428,487 A * 1/1984 Hepp ..... A47B 87/0246 108/92
5,359,752 A 11/1994 Domenig
5,469,961 A * 11/1995 Chang ..... F16K 41/12 206/307
5,503,277 A 4/1996 O'Brien
5,601,196 A 2/1997 Heer et al.
5,669,515 A 9/1997 Tisbo et al.
5,799,915 A 9/1998 Morey
6,176,559 B1 1/2001 Tiramani et al.
6,347,847 B1 2/2002 Tiramani et al.
6,415,924 B1 7/2002 Lee
6,499,608 B1 12/2002 Sterling et al.
6,564,949 B1 5/2003 Saathoff
6,601,930 B2 8/2003 Tiramani et al.
6,889,838 B2 * 5/2005 Meier ..... B25H 3/026 206/508
7,246,718 B2 * 7/2007 Einav ..... E05B 65/5253 220/764
D627,967 S * 11/2010 Kuhls ..... D3/273
7,832,584 B2 11/2010 Eggers et al.
7,845,653 B2 12/2010 Katz
7,938,412 B2 5/2011 Katz
D639,059 S 6/2011 Fraiman et al.
8,002,124 B2 8/2011 Lin et al.
8,061,536 B2 11/2011 Lin et al.
8,132,819 B2 3/2012 Landau et al.
8,191,845 B1 6/2012 Yu
8,505,729 B2 8/2013 Sosnovsky et al.
8,567,796 B2 10/2013 Bar-Erez et al.
8,590,704 B2 11/2013 Koenig et al.
8,602,217 B2 12/2013 Sosnovsky et al.
8,657,307 B2 2/2014 Lifshitz et al.
8,714,355 B2 5/2014 Huang
8,875,888 B2 * 11/2014 Koenig ..... B65D 21/0223 206/508
8,936,258 B2 1/2015 Bar-Erez et al.
8,967,438 B2 3/2015 Russell et al.
8,979,100 B2 3/2015 Bensman et al.
9,132,543 B2 9/2015 Bar-Erez et al.
9,206,827 B2 12/2015 Loree et al.
9,393,685 B2 7/2016 Chen
9,566,990 B2 2/2017 Bar-Erez et al.
9,643,629 B2 5/2017 Bar-Erez et al.
9,701,443 B2 7/2017 Wang
9,725,209 B1 8/2017 Ben-Gigi
9,962,825 B2 5/2018 Gonzales et al.
10,022,856 B2 7/2018 Bensman et al.
10,047,546 B2 8/2018 Brunner
RE47,022 E 9/2018 Sosnovsky et al.
10,106,180 B2 10/2018 Bar-Erez et al.
10,138,032 B2 11/2018 Chang
10,179,672 B2 1/2019 Kuhls et al.
10,293,476 B2 5/2019 Fleischmann
10,293,477 B2 5/2019 Wolle et al.
D851,399 S 6/2019 Sarfati et al.
10,357,089 B2 7/2019 Aoki
10,575,417 B2 2/2020 Sabbag et al.
10,583,962 B2 * 3/2020 Brunner ..... A45C 7/005
D880,155 S 4/2020 Feng
10,703,534 B2 7/2020 Brunner et al.
D896,517 S 9/2020 Brunner et al.
10,793,172 B2 10/2020 Brunner
11,006,749 B2 5/2021 Anderson et al.
D923,935 S * 7/2021 Brunner ..... D3/276
11,155,382 B1 * 10/2021 Cai ..... B65D 21/0223
D935,771 S 11/2021 Brunner et al.
D970,847 S 11/2022 Chen
2002/0053529 A1 * 5/2002 White ..... B42F 7/145 206/425
2004/0060844 A1 * 4/2004 Stahl ..... B65D 21/046 206/499
2005/0224494 A1 10/2005 Heinrichs
2005/0269276 A1 12/2005 Pfeiffer
2007/0125731 A1 6/2007 Waterman
2008/0000853 A1 1/2008 Huang
2008/0006592 A1 1/2008 Brooks
2008/0054142 A1 3/2008 Deland
2008/0121547 A1 5/2008 Dur et al.
2009/0139892 A1 * 6/2009 Vovan ..... B65D 21/0228 206/508
2009/0145866 A1 6/2009 Panosian et al.
2009/0236255 A1 * 9/2009 Piacenza ..... B65D 45/22 206/508
2010/0052276 A1 3/2010 Brunner et al.
2011/0062295 A1 3/2011 Totman
2011/0139665 A1 * 6/2011 Madsen ..... B25H 3/026 206/508
2011/0139666 A1 * 6/2011 Sosnovsky ..... B25H 3/021 206/508
2011/0139777 A1 6/2011 Sosnovsky et al.
2011/0155613 A1 * 6/2011 Koenig ..... B65D 21/0223 206/503
2011/0234072 A1 9/2011 Hightower
2012/0012726 A1 1/2012 Daniels
2013/0047386 A1 2/2013 Barfoot et al.
2014/0263119 A1 9/2014 Gruger et al.
2014/0319147 A1 10/2014 Horovitz et al.
2016/0168880 A1 * 6/2016 Phelan ..... B65D 55/14 206/1.5
2017/0151972 A1 6/2017 Bar-Erez et al.
2017/0166352 A1 6/2017 Hoppe et al.
2017/0274522 A1 9/2017 Kao
2017/0305596 A1 * 10/2017 Dag ..... B65D 5/0015
2017/0318927 A1 * 11/2017 Kraus ..... A45C 5/00
2018/0044059 A1 2/2018 Brunner
2018/0161975 A1 6/2018 Brunner
2019/0002004 A1 * 1/2019 Brunner ..... B25H 3/02
2019/0022537 A1 1/2019 Cummins
2019/0168376 A1 6/2019 Brocket et al.
2019/0225371 A1 7/2019 Hoppe et al.
2019/0247995 A1 8/2019 Hocine et al.
2019/0291922 A1 9/2019 Gonitianer et al.
2020/0147781 A1 5/2020 Squires et al.
2020/0165036 A1 5/2020 Squires et al.
2020/0189636 A1 6/2020 Brunner
2020/0223585 A1 7/2020 Brunner et al.
2020/0262459 A1 8/2020 Brunner
2020/0284425 A1 * 9/2020 Plato ..... B25H 3/02
2020/0299027 A1 9/2020 Brunner et al.
2021/0016928 A1 1/2021 Brunner et al.
2021/0039831 A1 2/2021 Brunner et al.
2021/0221561 A1 * 7/2021 Davidian ..... B25H 3/02
2021/0316909 A1 * 10/2021 Vargo ..... B65D 21/0217
2022/0041336 A1 * 2/2022 Barabeisch ..... B65D 25/2841
2022/0099420 A1 * 3/2022 Padgett ..... F42B 39/26

(56) References Cited

U.S. PATENT DOCUMENTS

| | | | | |
|---|---|---|---|---|
| 2022/0111999 | A1* | 4/2022 | Bunnik | B65D 21/0223 |
| 2022/0242613 | A1* | 8/2022 | Holzleithner | B65D 21/0235 |
| 2022/0322828 | A1 | 10/2022 | Barton | |

FOREIGN PATENT DOCUMENTS

| | | | |
|---|---|---|---|
| CA | 2989919 | A1 | 2/2017 |
| CA | 2714163 | C | 8/2018 |
| CN | 101885179 | A | 11/2010 |
| CN | 202624826 | U | 12/2012 |
| CN | 203427004 | U | 2/2014 |
| CN | 207480547 | U | 6/2018 |
| CN | 106477186 | B | 9/2018 |
| CN | 208428223 | U | 1/2019 |
| CN | 208470372 | U | 2/2019 |
| CN | 208514468 | U | 2/2019 |
| CN | 208887986 | U | 5/2019 |
| CN | 209289229 | U1 | 8/2019 |
| CN | 209774596 | U1 | 12/2019 |
| DE | 202006008894 | U1 | 8/2006 |
| DE | 202014008993 | U1 | 1/2015 |
| DE | 102014010378 | A1 | 1/2016 |
| DE | 102015013053 | A1 | 4/2017 |
| DE | 102016218116 | A1 | 3/2018 |
| EP | 0555533 | B1 | 8/1994 |
| EP | 1516703 | B1 | 3/2007 |
| EP | 2805799 | B1 | 11/2016 |
| EP | 3189944 | B1 | 6/2018 |
| GB | 692638 | A | 6/1953 |
| WO | 2010084309 | A1 | 7/2010 |
| WO | 2019123465 | A1 | 6/2019 |
| WO | 2019147801 | A2 | 8/2019 |
| WO | 2019150370 | A1 | 8/2019 |
| WO | 2020208640 | A1 | 10/2020 |

OTHER PUBLICATIONS

Extended European Search Report for Application No. 21152606.6 dated Jun. 29, 2021 (11 pages).

* cited by examiner

STACKABLE STORAGE SYSTEM

CROSS-REFERENCE TO RELATED APPLICATIONS

This application claims to the benefit of U.S. Provisional Patent Application No. 62/963,234, filed Jan. 20, 2020, U.S. Provisional Patent Application No. 63/030,694, filed May 27, 2020, and U.S. Provisional Patent Application No. 63/070,633, filed Aug. 26, 2020. The entire contents of these applications are incorporated by reference herein.

TECHNICAL FIELD

The present disclosure relates to storage containers and, more particularly, to storage containers that are securable to one another in a stackable configuration.

BACKGROUND

A stackable storage system may include multiple storage containers each having a lid and base. The base of an upper container may be placed on the lid of a lower container, and one of the containers may include a latch mechanism. The latching mechanism may be operable to selectively couple and de-couple adjacent storage containers.

SUMMARY

In one independent aspect, a stackable storage system includes a first container, a second container, and a latch moveable between a first position and a second position. The first container includes a projection extending away from the first container along a stacking direction. An edge portion extends from the projection along a plane substantially perpendicular to the stacking direction. The second container includes a recess extending in a direction parallel to the stacking direction. The recess receives the projection when the first container and the second container are stacked relative to one another in the stacking direction. The latch overlaps the edge portion with respect to the stacking direction while the latch is in the first position to secure the first container and the second container to one another. The latch and edge portion are positioned in a non-overlapping manner relative to one another with respect to the stacking direction while the latch is in the second position to permit separation of the first container from the second container.

In another independent aspect, a mating interface is provided for selectively securing a first container relative to a second container in a stacked configuration along a stacking direction. The interface includes a projection and a coupler. The projection is positioned on one of the first container and the second container. The projection is spaced apart from a surface to form a gap. The gap is open in a direction transverse to the stacking direction. The coupler is moveably mounted on the other of the first container and the second container. The coupler is moveable in the direction transverse to the stacking direction between a first position and a second position. In the first position, a portion of the coupler is positioned within the gap thereby preventing the first container and the second container from being separated along the stacking direction. In the second position, the coupler is not positioned within the gap.

In yet another independent aspect, a storage container includes a base, a lid pivotably coupled to the base by a hinge and selectively retained in a closed position, a plurality of pockets positioned on one of the base and the lid, a surface formed on the other of the base and the lid, and a plurality of projections. The plurality of pockets have sides recessed with respect to a first direction. Each of the pockets has a polygonal profile, at least one edge of each pocket is oriented at an oblique angle relative to a front surface of the base. The plurality of projections extends from the surface with respect to the first direction. Each of the projections has a projection profile substantially corresponding to an associated one of the pockets. Each of the projections is substantially aligned with the associated one of the pockets along the first direction. An edge portion protrudes from one of the projections in a plane substantially normal with respect to the first direction. The edge portion is oriented at the oblique angle relative to a front surface of the base. A gap is formed between the edge portion and the surface. A latch is moveable against a biasing force in a second direction transverse to the first direction, the latch moveable between a first position and a second position. At least a portion of the latch extends through at least one side of the pockets while the latch is in the first position. The latch is retracted with respect to the sides of the pockets while the latch is in the second position.

In still another independent aspect, a stackable storage system includes a first container, a second container, and a coupler. The first container includes a first surface defining a first coupling portion, and the second container includes a second surface opposite the first surface defining a second coupling portion aligned with the first coupling portion. The coupler is disposed between the first coupling portion and the second coupling portion and is configured to move between portions of the first coupling portion and the second coupling portion to selectively lock the first container to the second container.

Other aspects will become apparent by consideration of the detailed description and accompanying drawings.

Before any embodiments of the disclosure are explained in detail, it is to be understood that the disclosure is not limited in its application to the details of construction and the arrangement of components set forth in the following description or illustrated in the following drawings. The subject matter is capable of other embodiments and of being practiced or of being carried out in various ways. Also, it is to be understood that the phraseology and terminology used herein is for the purpose of description and should not be regarded as limiting. Use of "including," "comprising," or "having" and variations thereof as used herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Additionally, unless specified or limited otherwise, the terms "lower," "upper," and variations thereof are used broadly for the purposes of describing relative positions of elements of the illustrated embodiments.

DETAILED DESCRIPTION

Figure 1A:
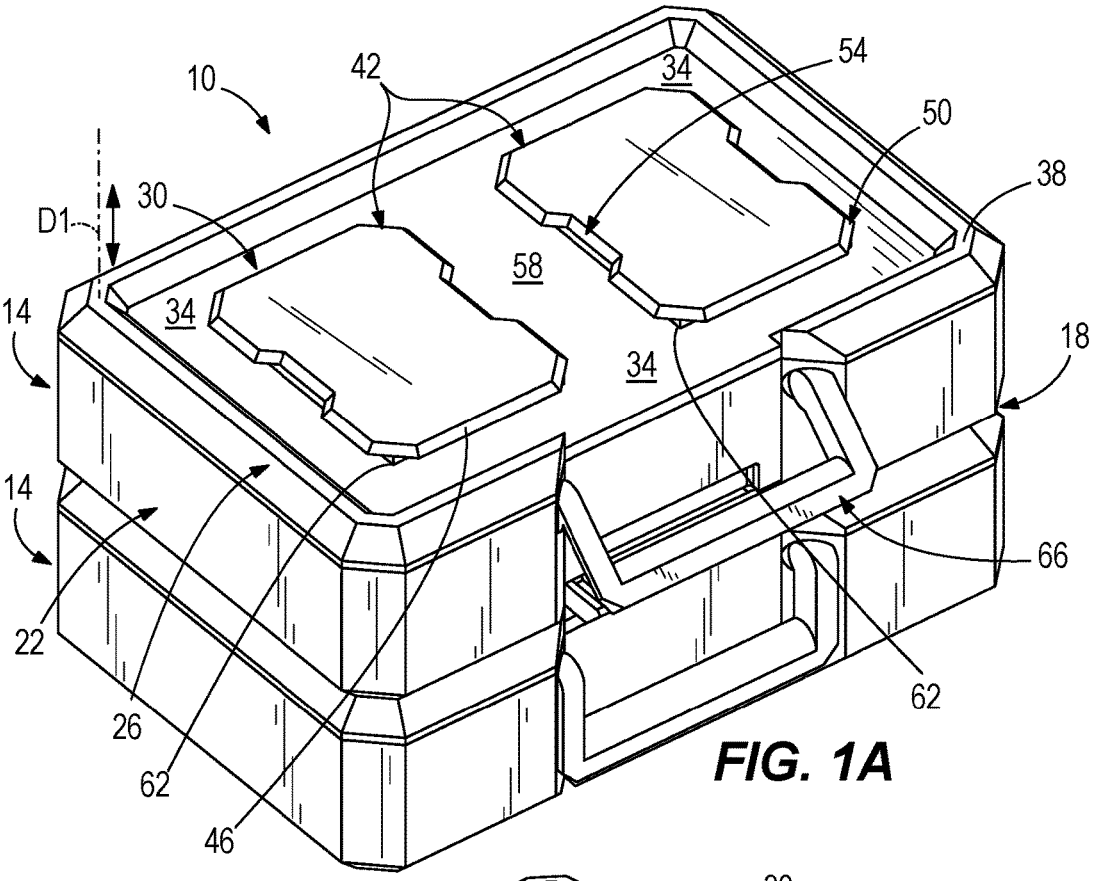
FIG. 1A is an upper perspective view of a stackable storage system.
Figure 1B:
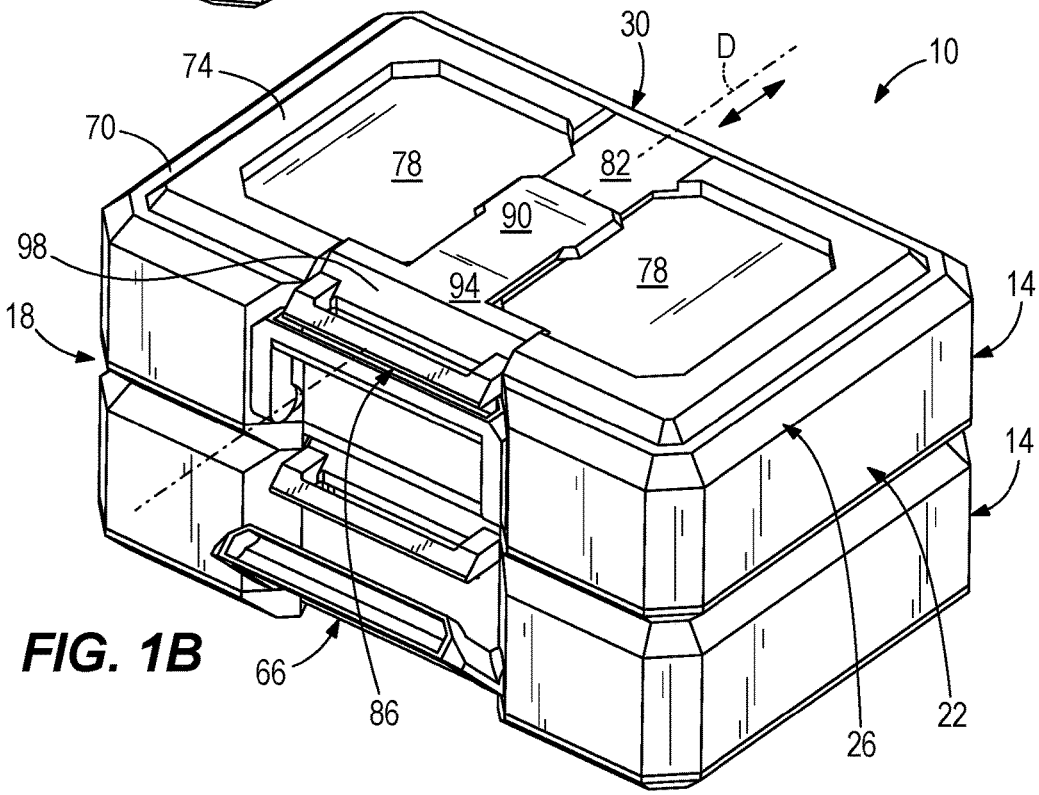
FIG. 1B is a lower perspective view of the storage system of FIG. 1A.

FIGS. 1A and 1B illustrate a system 10 of multiple storage components or elements 14 (e.g., containers, toolboxes, and/or the like) in a stacked configuration and secured relative to one another along a stacked or stacking direction D1. The system 10 includes an interface 18 for mating opposite and optionally complementary surfaces of the storage containers 14 relative to one another. Each storage container 14 may include a base 22 and a lid 26 rotatably coupled to the base 22 by a hinge 30. In the illustrated embodiment, an upper surface of the lid 26 includes a surface 34 at least partially surrounded by a peripheral lip 38. In the illustrated embodiment, the lip 38 extends upwardly from the surface 34, and in some embodiments the surface 34 may be depressed. As persons having skill in the art will appreciate, containers having non-hinged and/or non-rotatable lids (e.g., translating lids) are contemplated herein. Some embodiments may include, for example, removable lids (e.g., lids having latches without pivoting and/or hinges) and/or drawers that slide relative to another structure or stationary cover, and/or the like.

The lid 26 includes one or more projections 42 that extend from the surface 34. Each of the projections 42 may include a base and an overhanging portion or tab 46 supported on the projection 42. The projections 42 may include rectangular or non-rectangular shapes, and symmetric or asymmetric shapes. Much of the tab 46 extends outwardly from the projection 42 in a direction parallel to the surface 34 and is spaced apart from the surface 34 in the stacking direction D1. In the illustrated embodiment, the tab 46 includes an inclined or ramped surface 50 and extends from the projection 42 to provide an hourglass-shaped profile when viewed from above the surface 34. The tab 46 does not extend outwardly from the projection 42 beyond a rectangular base in a center portion of the hourglass shaped profile. Stated another way, a slot 54 may be disposed or formed between two or more portions of the tab 46, forming a region in which the tab 46 does not extend over the surface 34 with respect to the stacking direction D1. In the illustrated embodiment, the ramped surface 50 of the tab 46 is provided on a top portion of the tab 46 to permit sliding of components on the base 22. In other embodiments, the ramped surface 50 may be provided on a different portion of the tab 46, and in still other embodiments, the tab 46 may be formed without a ramped surface. For example, the tab 46 may be formed with a planar or non-ramped surface 50.

In the illustrated embodiment, the projections 42 extend from the surface 34 adjacent one another such that a portion of the tab 46 extends outwardly toward an adjacent projection 42. The projections 42 may be arranged next to one another such that a polygonal-shaped pocket 58 is formed between the slots 54. In other embodiments, the pocket 58 may be a different shape, and any number of pockets 58 may be arranged with any number of projections 42. In the illustrated embodiment, the profile of the tabs 46 combined with the position of the projections 42 forms a slit or gap 62 (FIG. 2B) between the surface 34 and the tabs 46 such that the gap 62 has a depth defined along the stacking direction D1. In the illustrated embodiment, the slot 54 on each projection 42 is terminated by the tab 46 on either side, and no gap 62 may be formed by the slots 54.

With continued reference to FIGS. 1A and 1B, the base 22 may include a handle 66, a first surface 70, a second surface 74 offset from the first surface 70, at least one depression or cavity 78 formed in the second surface 74, an elongated channel 82, and a coupler or latch 86. The handle 66 may be formed as part of the base 22 or mounted thereon to accommodate handling and/or carrying of the storage container 14. As persons having skill in the art will appreciate, channel 82 may be provided in any shape (e.g., a square, or any shape other than an elongated channel), and any orientation (e.g., elongated in a second direction) as desired.

The first surface 70 of the base 22 may be planar and may substantially surround the second surface 74. The first surface 70 is configured to contact the outer lip 38 of the lid 26 when the base 22 of one container 14 is stacked relative to the lid 26 of another container 14. Similarly, the second surface 74 of one container 14 is configured to contact the surface 34 of another container, and the at least one cavity 78 is configured to receive at least one corresponding projection 42. The various complementary surfaces of the lid 26 and the base 22 provide the mating interface 18 between adjacent containers 14. The various complementary surfaces of the lid 26 and the base 22 also limit the lid 26 and base 22 from shifting relative to one another in the direction parallel to the surface 34 while stacked. In this way, the containers 14 are more stable when stacked and are less likely to become unstacked during use and/or transportation.

Referring now to FIGS. 1B-3B, the elongated channel 82 of the base 22 is formed between the cavities 78 to support a portion of the latch 86. The latch 86 includes a locking portion or locking member 90 (e.g., a tab, lug, bar, arm, and/or the like), and a base portion 94 having ramped surfaces 98 and a grip 102. As illustrated in FIG. 1B, the latch 86 is slidable along axis D, which is parallel to the surface 34 (e.g., in a transverse direction relative to the stacking direction D1), and supported in the channel 82, which is offset from the second surface 74. The latch 86 is supported such that when the base 22 of one container 14 is stacked on the lid 26 of the other container 14, the locking member 90 sits on the base 22 and lies in a plane between the surface 34 and the tab 46 (FIGS. 2B and 3B) with respect to the stacking direction D1.

Figure 2A:
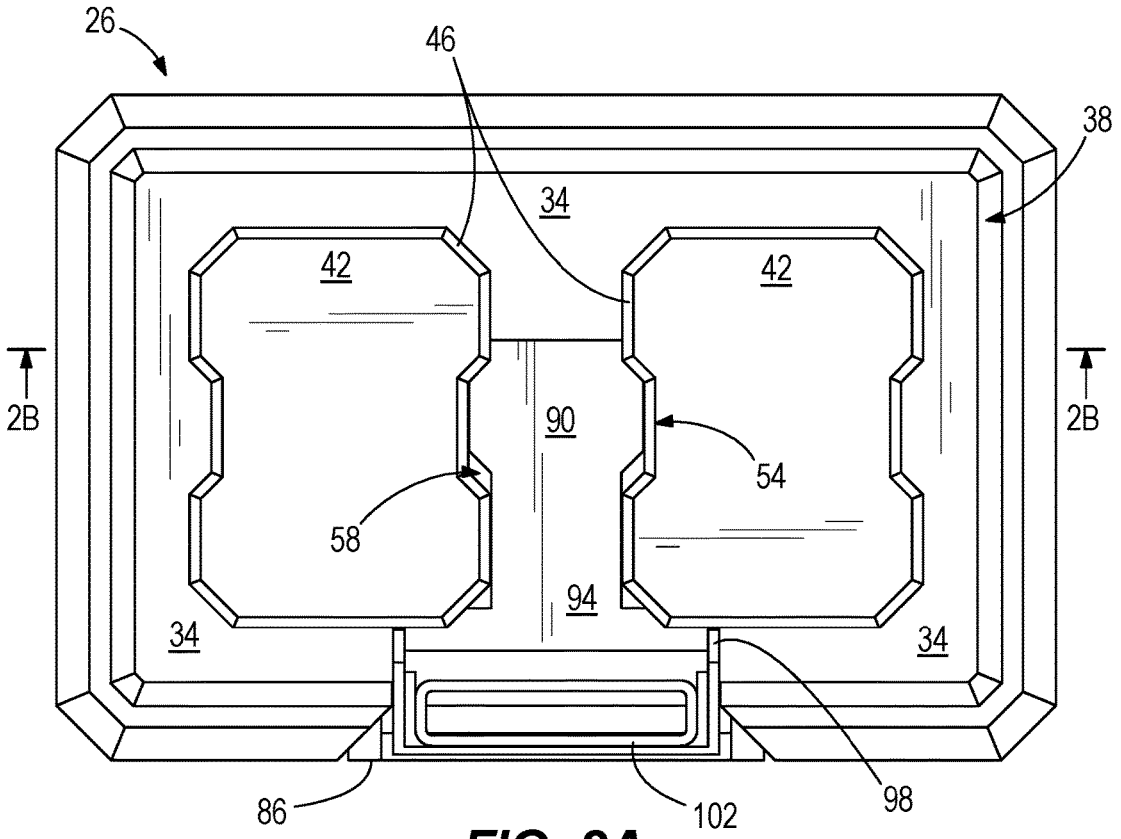
FIG. 2A is an upper plan view of the storage system of FIG. 1A with a portion of an upper storage element hidden to show a latching mechanism in an engaged position with a lower storage element.
Figure 2B:
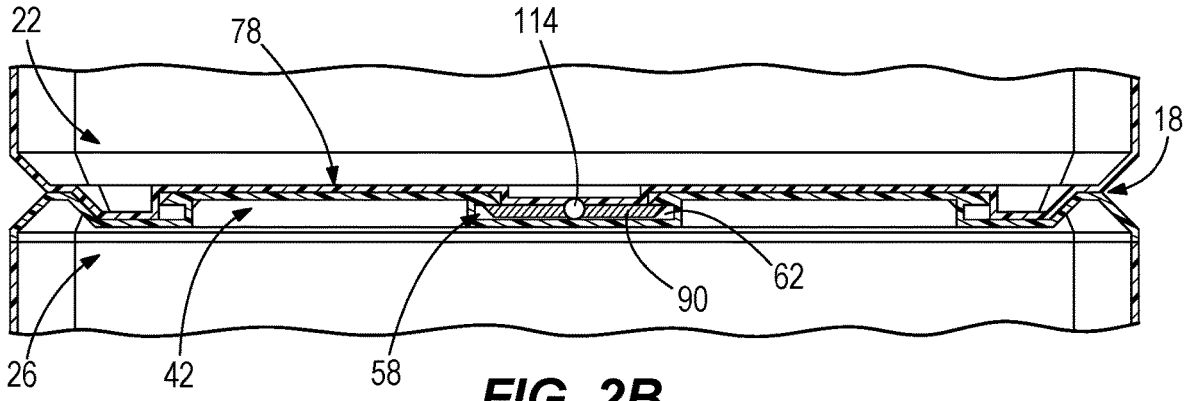
FIG. 2B is a cross-sectional view of the storage system of FIG. 1A, viewed along section 2B-2B, with the latching mechanism in the engaged position.

In the illustrated embodiment, the latch 86 is slidable relative to the base 22 and lid 26 across the stacking direction D1 between a first position (FIG. 2A) in which the base 22 and lid 26 are prevented from separating, and a second position (FIG. 3A) in which the base 22 and lid 26 are allowed to separate. In the first position, the locking member 90 lies partially within the pocket 58 and partially within the gap 62 (FIG. 1A). FIG. 2B illustrates a portion of the locking member 90 engaging the tab 46 and overlapping the tab 46 along the stacking direction D1 while in the first position, thereby securing the storage containers 14 against separation from one another. In another embodiment, a greater portion of the locking member 90 engages the tab 46 and little to no portion of the locking member 90 lies within the pocket 58. In the first position, the locking member 90 at least partially overlaps above the surface 34 and below the tab 46, which therefore prevents separation of the storage containers 14. The locking member 90 may be slidable to lock and unlock adjacent containers 14 in some embodiments, however, non-sliding locking members 90 are also contemplated. For example, a locking member 90 that raises and lowers to lock and unlock adjacent containers 14 together is contemplated, as well as a locking member 90 that pivots (e.g., rocks) about a pivot point to lock and unlock adjacent containers 14.

Figure 3A:
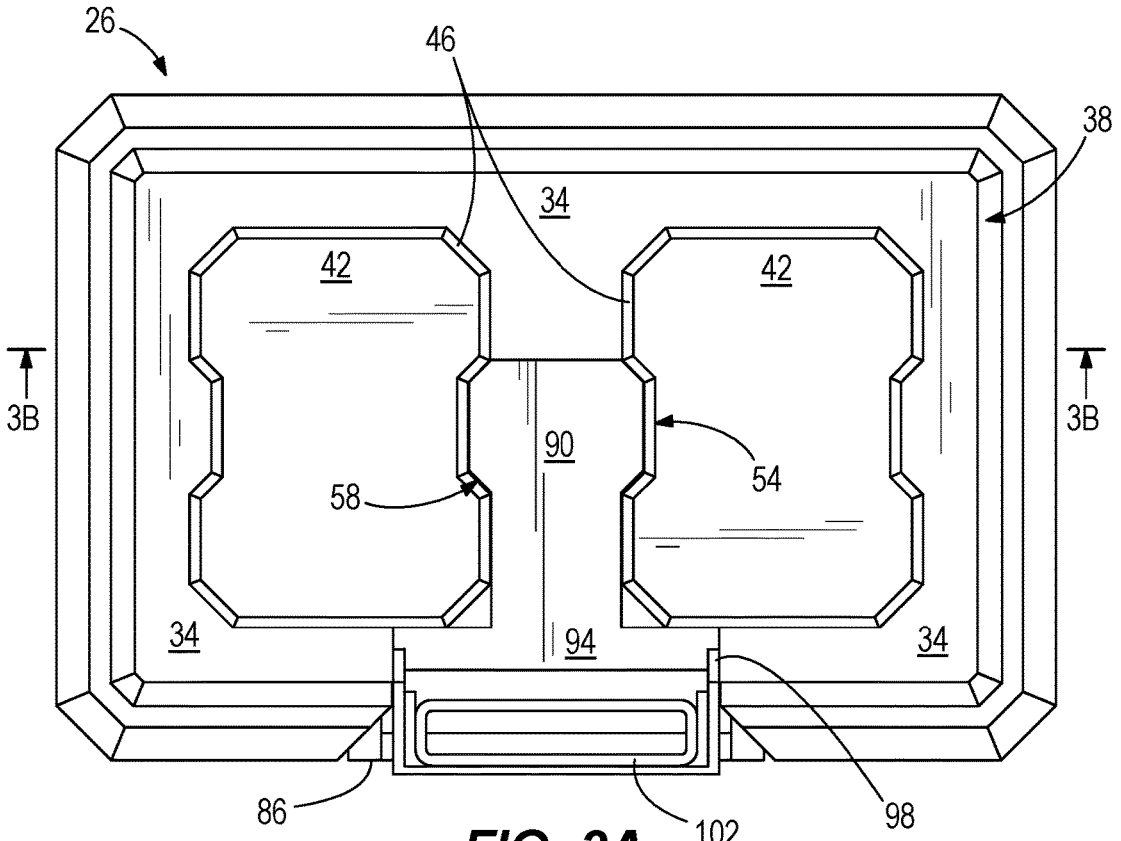
FIG. 3A is an upper plan view of the storage system of FIG. 1A with a portion of an upper storage element hidden to show the latching mechanism of FIG. 2A in a disengaged position.
Figure 3B:
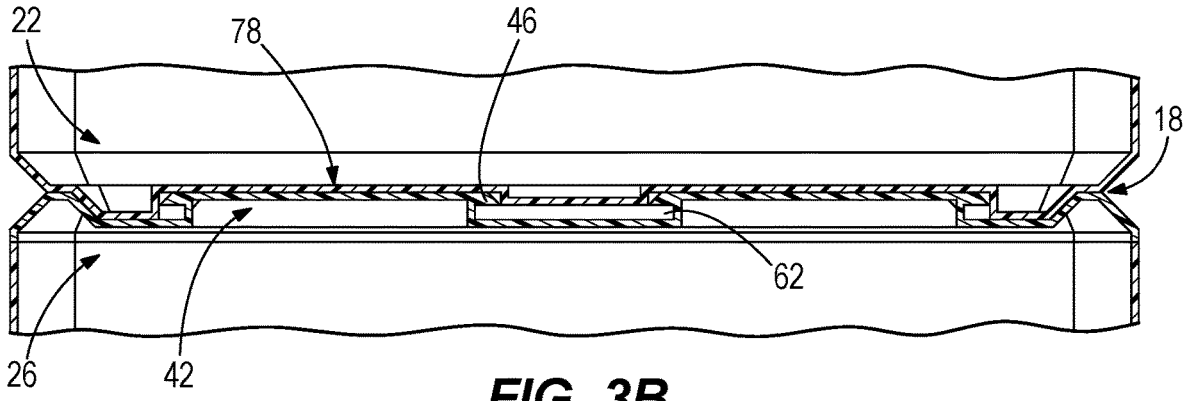
FIG. 3B is a cross-sectional view of the storage system of FIG. 1A, viewed along section 3B-3B, with the latching mechanism in the disengaged position.
Figure 4A:
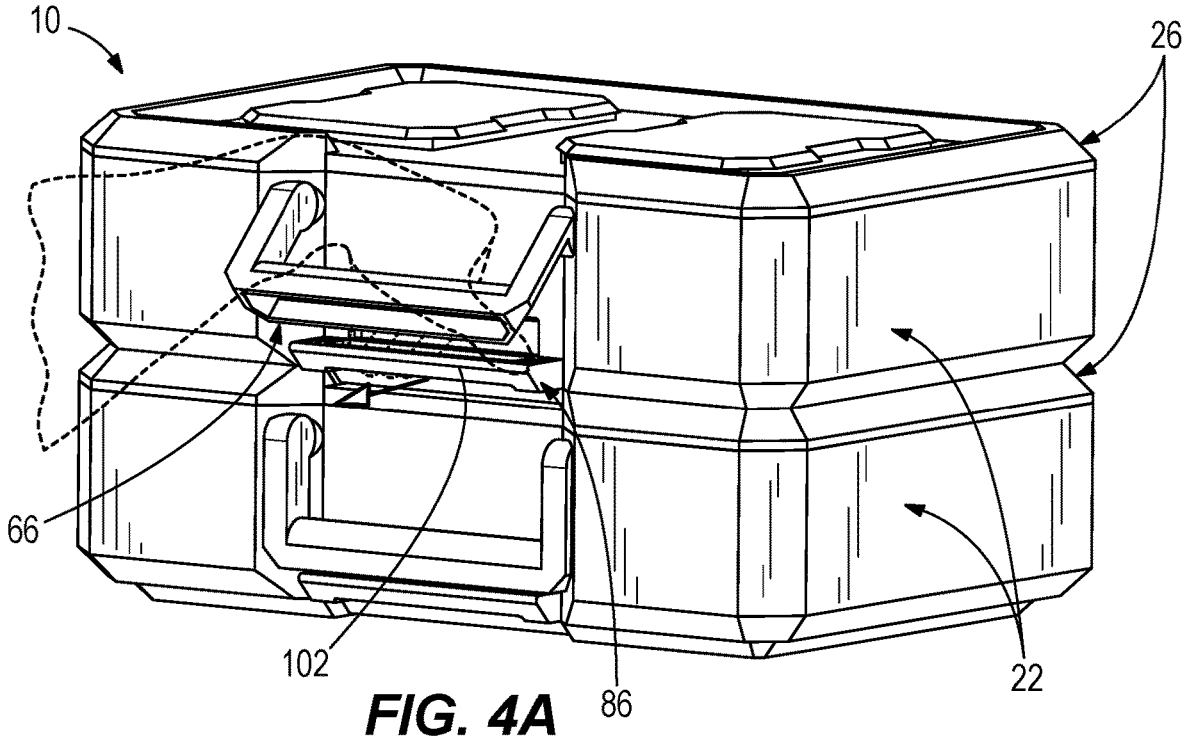
FIG. 4A is a perspective view illustrating operation of a latching mechanism before separation of one storage element away from another storage element.
Figure 4B:
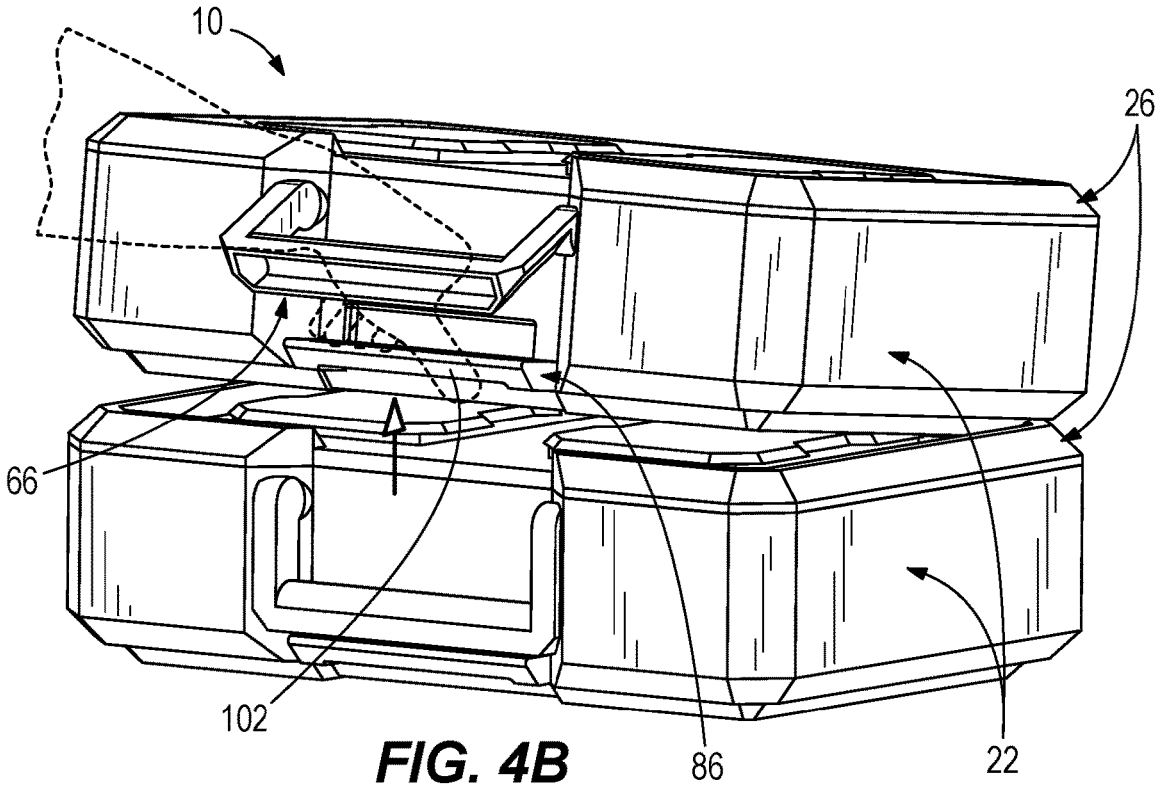
FIG. 4B is a perspective view illustrating separation of one storage element away from another storage element.

In the second position, the locking member 90 lies fully within the pocket 58 and does not engage the tab 46 (FIG. 3B) or overlap the tab 46 with respect to the stacking direction D1, thereby allowing the storage containers 14 to be separated. FIGS. 3A and 3B illustrate the second position of the latch 86 in which no part of the latch 86 overlaps above and below the lid 26. Stated another way, while the latch 86 is in the second position, the locking member 90 is prevented from engaging the tabs 46 and is substantially allowed to slide vertically through the pocket 58 so that the storage containers 14 may be separated from one another.

Referring now to FIGS. 3A-4B, the base portion 94 of the latch 86 supports the locking member 90 and includes the ramped surfaces 98 and the grip portion 102. The latch 86 is configured to be movable (e.g., slidable, pivotable, and/or the like) from the first position, against a biasing force exerted by a biasing member 114, into the second position. In some embodiments, the biasing force exerted by the biasing member 114 biases the latch 86 toward the first position, regardless of whether the storage containers 14 are stacked relative to one another. In the illustrated embodiment, the latch 86 is biased toward the first position in order to secure the storage containers 14 together and/or to facilitate quick connection between the storage containers 14. The ramped surface 98 of the latch base 94 allows a sliding contact-type connection between the lid 26 and the ramped portion 98 as multiple storage containers 14 are stacked relative to one another along the stacking direction D1. In the illustrated embodiment, the stacking direction D1 is substantially vertical. As the storage containers 14 are brought into contact with one another, primarily along the stacking direction D1, the lid 26 slides along the ramped portion 98 of the locking member 90 to translate the latch 86, against the biasing force, toward the second position. Once the storage containers 14 contact one another (e.g., contact between surface 34 and surface 74), the latch 86 releases, and the biasing force urges the latch 86 toward the first position.

In order to move the latch 86 to the second position, a user may engage the grip portion 102 of the latch 86. The grip portion 102 may be a link or handle portion 102. In some embodiments, the latch 86 is positioned to enable the latch 86 to be moved by the same hand that grasps the handle 66 (for example, the user's fingers can move the latch 86). The user's fingers can move the latch 86 against the biasing force while leveraging the user's hand against the handle 66. Once the latch 86 is operated into the second position, the storage containers 14 may be separated relative to one another along the stacking direction D1. After the containers 14 have been separated, the latch 86 may be released and shifted toward the first position by a biasing force.

In the illustrated embodiment, while the latch 86 is in the second position, the storage containers 14 are separable generally by translational movement (e.g., relative movement between containers 14 in the stacking direction D1). Stated another way, once the storage containers 14 are released from one another (i.e., latch 86 in second position), little to no movement between the storage containers 14 other than in the stacking direction D1 is required to completely separate the storage containers 14 from one another. In a similar manner, during stacking of the adjacent storage containers 14, little to no force needs to be applied onto the storage system 10 other than in the stacking direction D1, by a user or otherwise, to secure the storage containers 14 together. In other embodiments, no lateral movement or force needs to occur/be applied by a user to either storage container 14 to connect or disconnect relative storage containers 14.

FIGS. 5-7B illustrate a coupler or latch 486 according to another embodiment. The latch 486 of FIGS. 5-7B is similar to the latch 86 described above with reference to FIGS. 1-4B, and similar features are identified with similar reference numbers, plus 400. Some differences between the latch 86 and the latch 486 are described.

Figure 5:
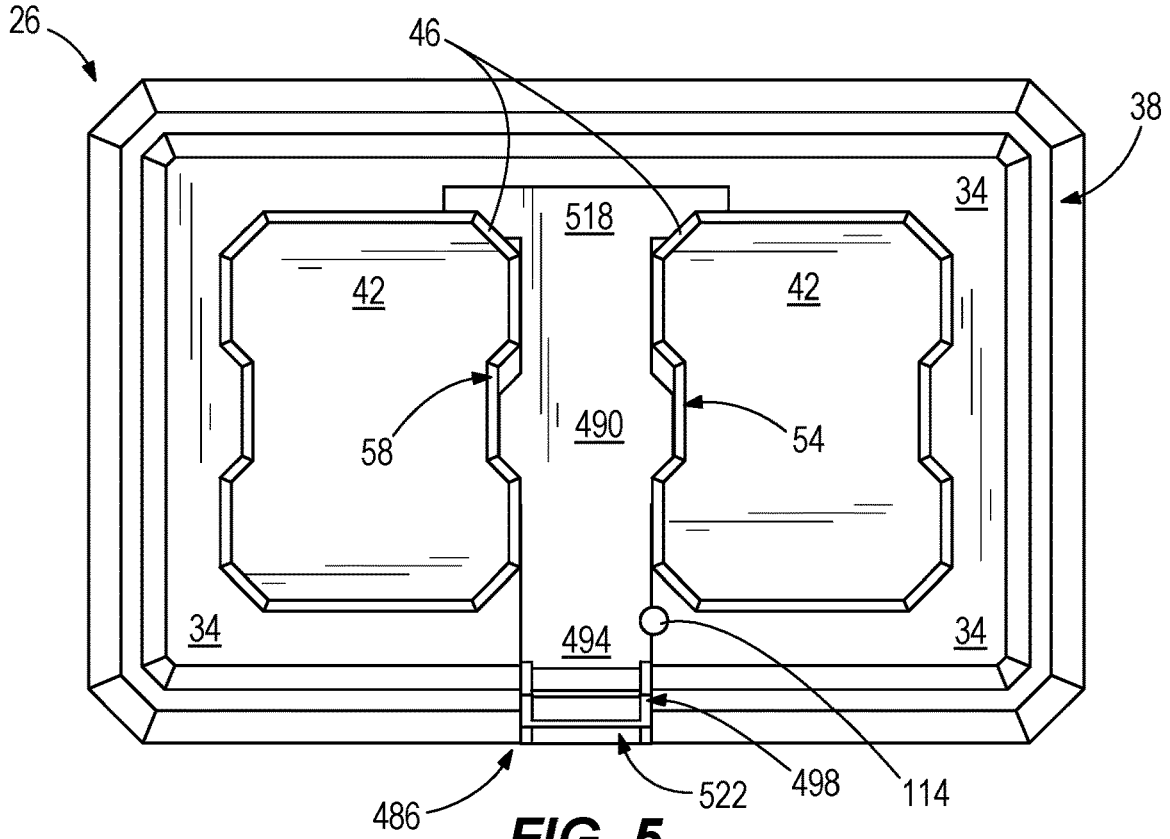
FIG. 5 is an upper plan view of the storage system with a portion of an upper storage element hidden to show a latching mechanism according to another embodiment in an engaged position with a lower storage element.
Figure 6:
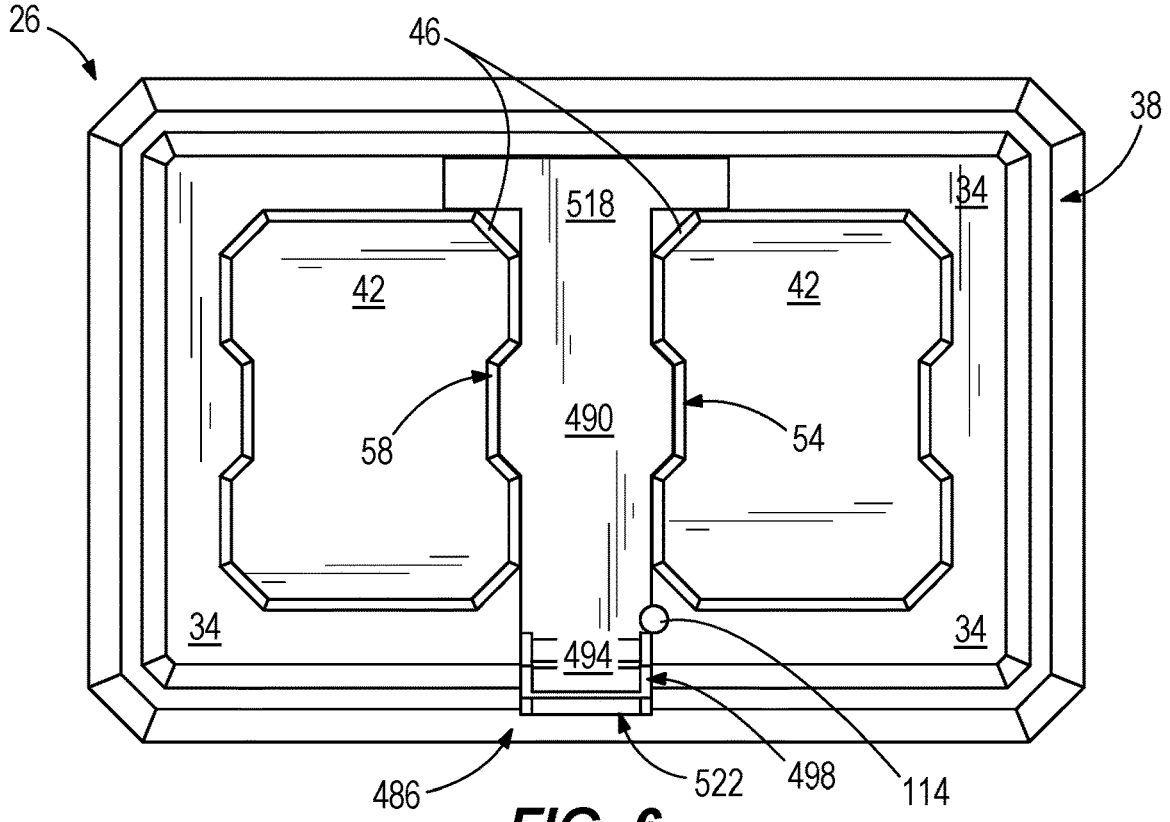
FIG. 6 is an upper plan view of the storage system with a portion of an upper storage element hidden to show the latching mechanism of FIG. 5 in a disengaged position.

The latch 486 may include a locking member 490 as well as a T-shaped extension 518 extending from the locking member 490, a base portion 494 having a ramped surface 498, and a push-button 522 for operating the position of the latch 486. The locking member 490 may also be embodied as a bar, tab, lug, or the like. As illustrated in FIGS. 5 and 6, the latch 486 is slidable in the direction parallel to the surface 34 between a first position (FIG. 5) and a second position (FIG. 6). In the first position, the locking member 490 may lie partially within the pocket 58 and partially within the gap 62, and the T-shaped extension 518 may lie partially between the tab 46 and the surface 34. In the first "locked" or "engaged" position, the locking member 490 and T-shaped extension 518 overlap the surface 34 and the tab 46, thereby preventing separation of the storage containers 14.

Referring now to FIG. 6, while the latch 486 is in the second or "unlocked" or "disengaged" position, the locking member 490 lies fully within the pocket 58, and the T-shaped extension 518 lies beyond (e.g., outside of) the tab 46. While in the second position, neither the locking member 490 nor the T-shaped extension 518 engage a portion of the tab 46, thereby allowing the storage containers 14 to be separated substantially along the stacking direction D1. FIG. 6 illustrates the second position of the latch 486 in which no part of the latch 486 overlaps the lid 26. Stated another way, while the latch 486 is in the second position, the locking member 490 and T-shaped extension 518 do not engage the tabs 46 and may pass the tabs 46 as the storage containers 14 are separated from one another.

The latch 486 may be moveable (e.g., slidable, translatable, pivotable, and/or the like) from the first position, against a biasing force exerted by a biasing member 514, into the second position. In the illustrated embodiment, the biasing force is oriented substantially opposite to the biasing force exerted on the latch 86 described above with respect to FIGS. 3-4B and biases the latch 486 toward the first position, for example, regardless of whether the storage containers 14 are stacked relative to one another. Biasing the latch 486 toward the first position may assist in facilitating quick connection between the storage containers 14.

Figure 7A:
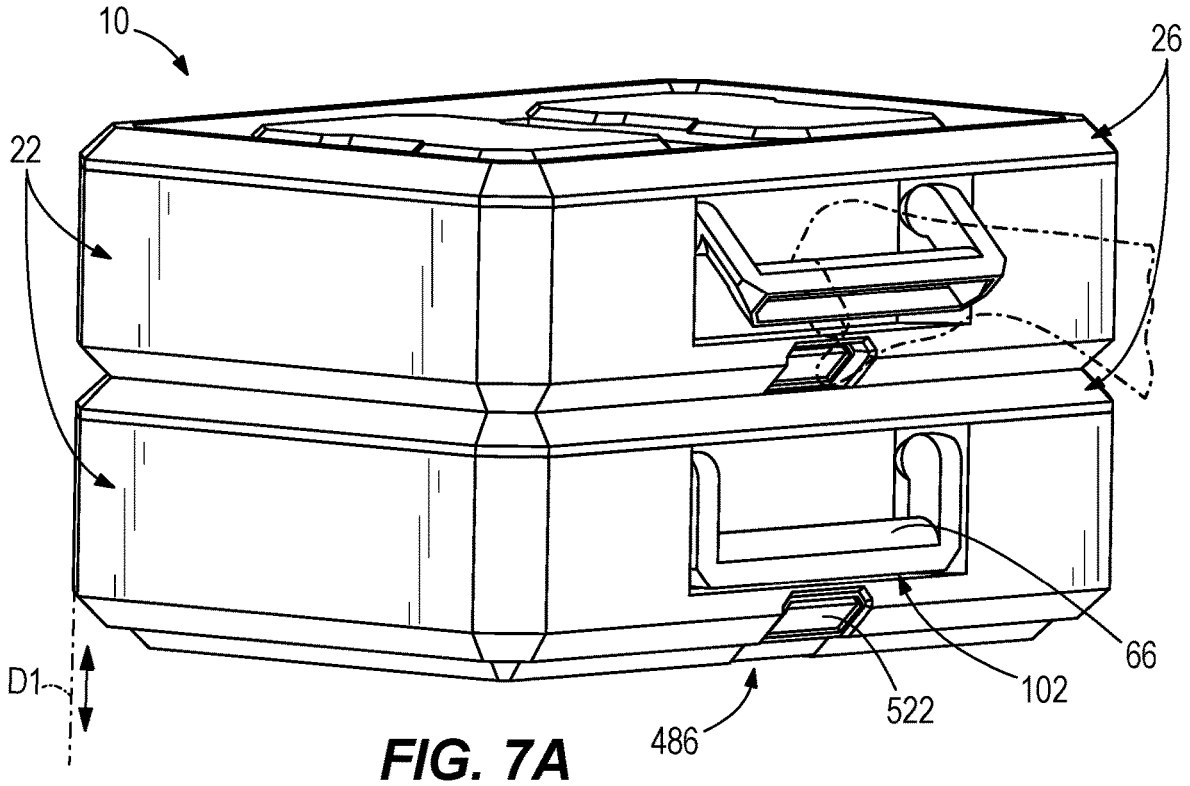
FIG. 7A is a perspective view illustrating operation of the latching mechanism of FIG. 5 before separation of one storage element away from another storage element.
Figure 7B:
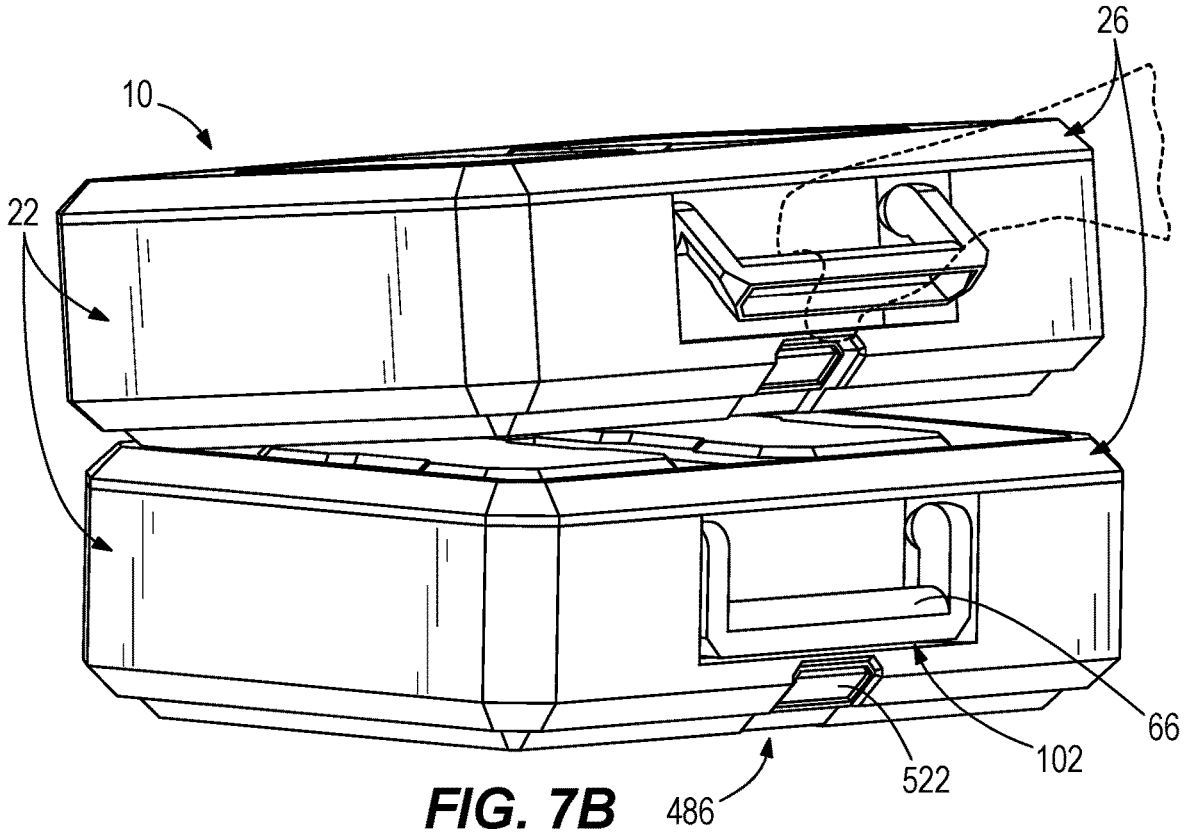
FIG. 7B is a perspective view illustrating separation of one storage element away from another storage element.

As shown in FIGS. 7A and 7B, in some embodiments, the latch 486 is positioned to enable actuation of the latch 486 by the same hand that grasps the handle 66. For example, a user may grasp the handle 66 with their palm and actuate the push-button 522 with a thumb to move the latch 486 against the biasing force while leveraging their palm on the handle 66. Once the latch 486 is moved to the second position, the storage containers 14 may be separated relative to one another along the stacking direction D1. After the containers 14 have been separated, the push-button 522 may be released to cause the latch 486 to move (e.g., via the spring bias) back to the first position.

Referring now to FIGS. 8A-9B, the lid 26 may include a plurality of projections 142 having more projections than described above with reference to FIGS. 1-7B. The projections 142 protrude from the surface 34 of the lid 26. In the illustrated embodiment, at least some of the projections 142 may be contiguous with the outer lip 38. Each of the projections 142 may include a rectangular base and a tab 146. The tab 146 may extend parallel to the surface 34 of the lid 26, forming a gap or space between the tab 146 and the surface 34. In the illustrated embodiment, the tab 146 may be positioned proximate a corner of each projection 142. In other embodiments, the tab 146 may be configured differently.

In the illustrated embodiment, the projections 142 are configured in a grid pattern on the surface 34 in two or more rows 150 of four or more projections 142 each; in other embodiments, the projections 142 may be arranged in fewer or more rows, and/or each of the rows 150 may include fewer or more projections. The tabs 146 may be located diagonally across from one another and/or face toward one another.

Figure 8A:
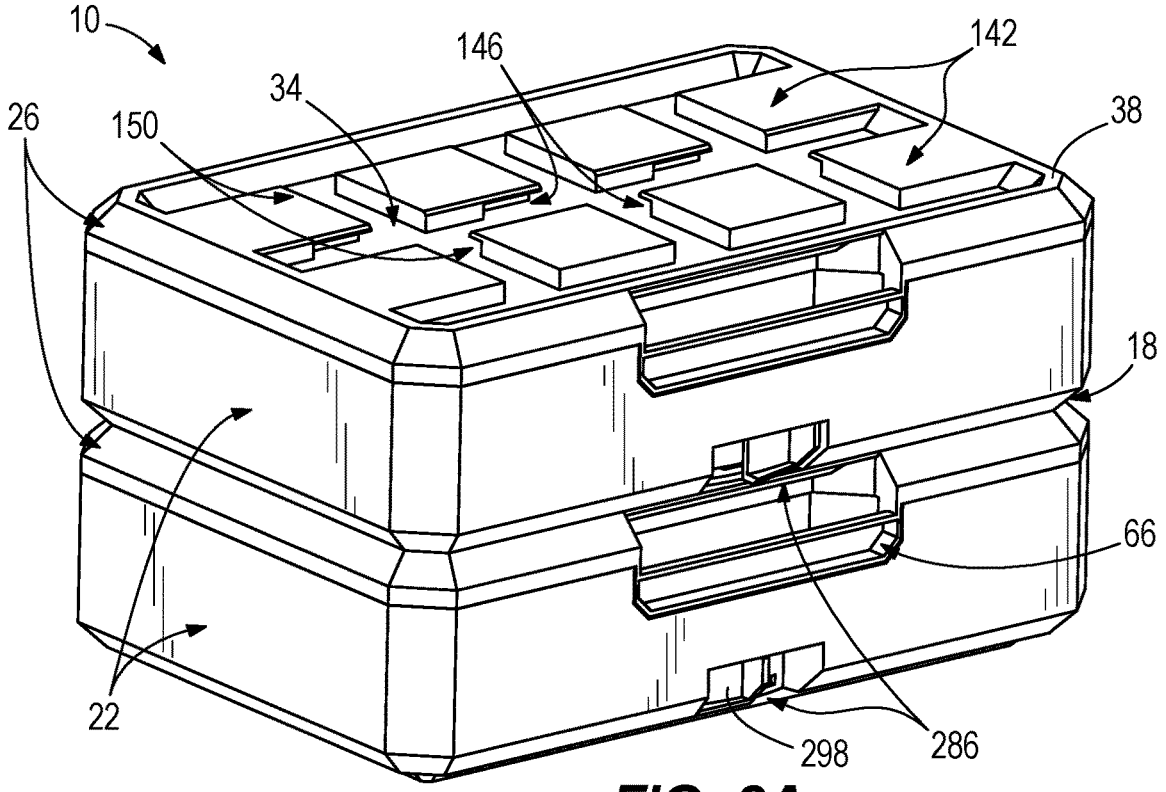
FIG. 8A is an upper perspective view of a stackable storage system according to another embodiment.
Figure 8B:
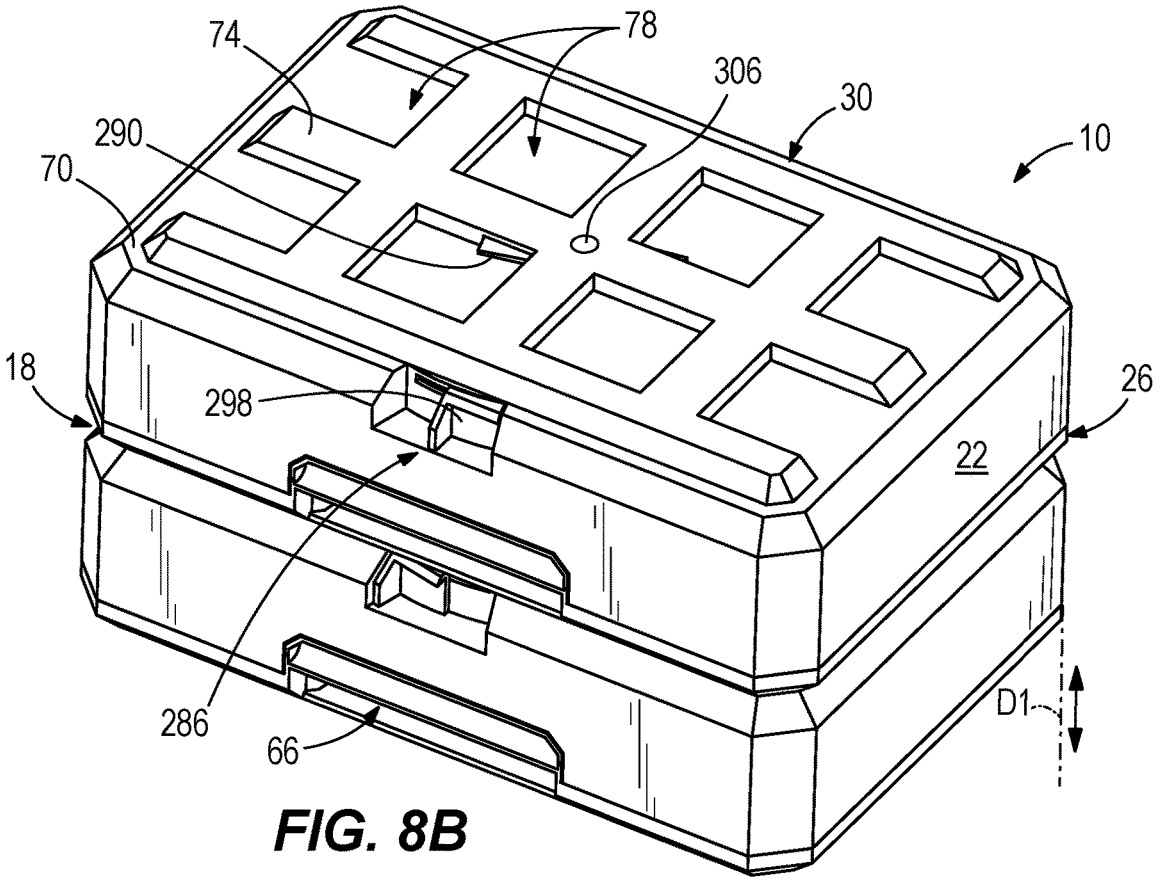
FIG. 8B is a lower perspective view of the storage system of FIG. 8A.

As shown in FIG. 8B, the base 22 includes a lower surface complementary to the surface of the lid 26. For example, the base 22 may include a first surface 70 complementary to the outer lip 38 of the lid 26, a second surface 74 offset from the first surface 70, and at least one depression or cavity 78. In the illustrated embodiment, the handle 66 may be mounted on the base 22 to accommodate handling and/or carrying of the storage container 14.

Figure 9A:
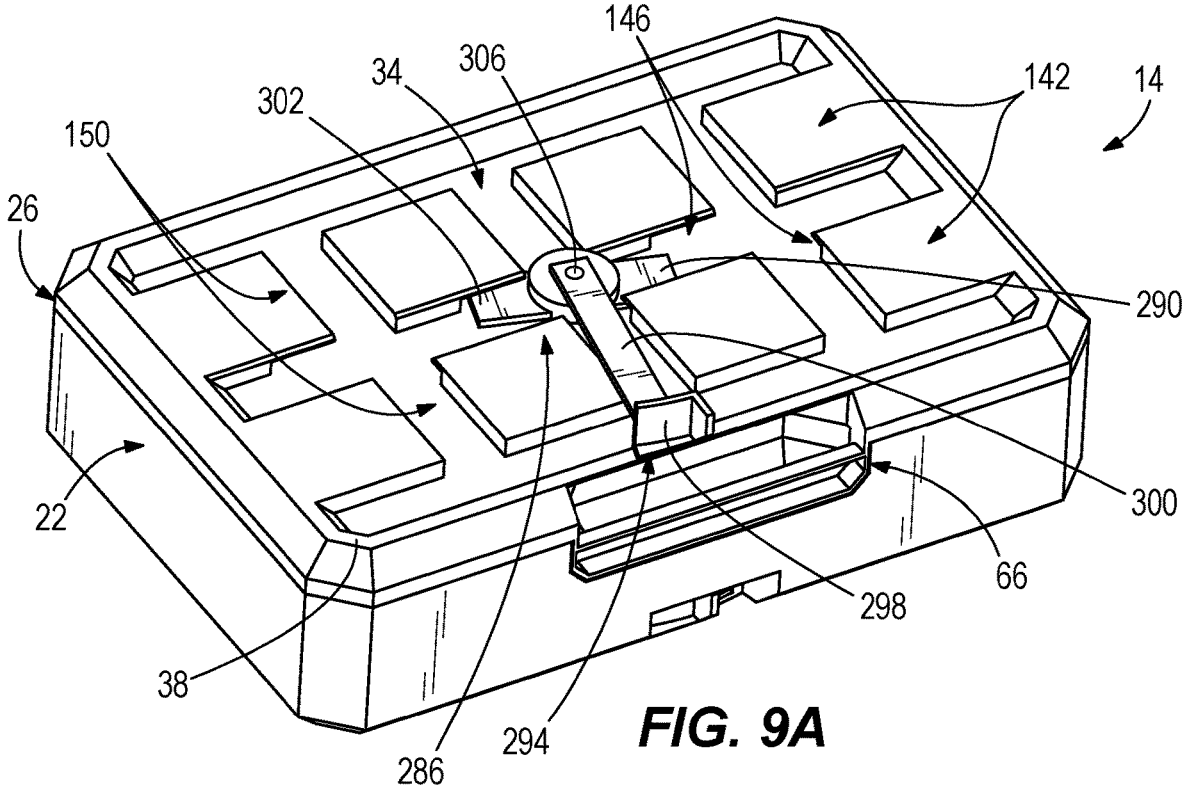
FIG. 9A is an upper perspective view of the stackable storage system of FIG. 8A with a portion of an upper storage element hidden to show a latching mechanism in an engaged position with a lower storage element.
Figure 9B:
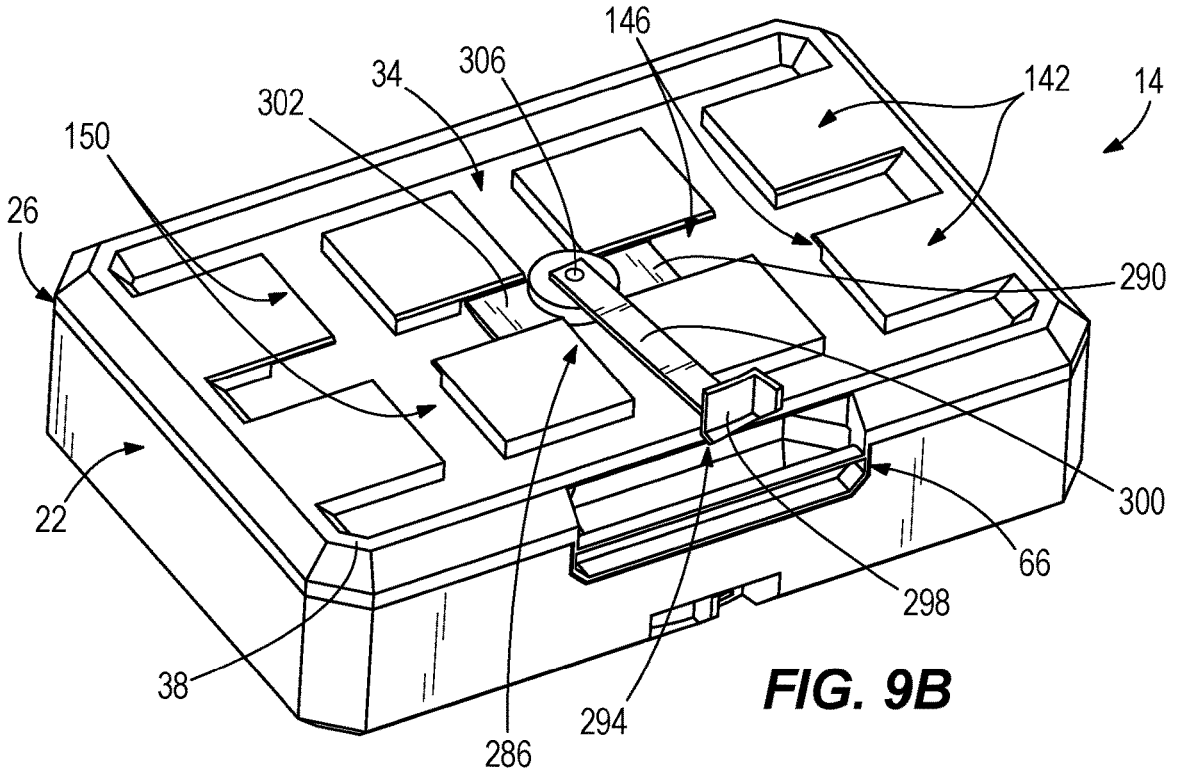
FIG. 9B is an upper perspective view of FIG. 9A showing the latching mechanism in a disengaged position.

FIGS. 9A and 9B illustrate a coupler or latch 286 for coupling one storage container to another. In the illustrated embodiment, the latch 286 is positioned adjacent a lower surface of the storage container. The latch 286 includes a bar or lug 290, a base portion 294 having a lever 298 for operating a position of the latch 286, and a body 300. The lug 290 includes a portion 302 for sliding engagement/contact between the tab 146 and the surface 34. The latch body 300 connects the lug 290 and the latch base 294 and may be housed within the storage container base 22.

The coupling latch 286 is rotatable in a plane parallel to the surface 34 of the lid 26 between a first position (FIG. 9A) and a second position (FIG. 9B). In the first position, the lug 290 partially fits between the tab 146 and the surface 34. In other embodiments, the tab may completely receive the lug.

Stated another way, in the first position, the lug 290 overlaps the surface 34 and the tab 146, thereby securing and/or locking multiple storage containers 14 against separation from one another. In the illustrated embodiment, a biasing member 306 exerts a force to bias the lug 290 toward the first position, regardless of whether the storage containers 14 are stacked relative to one another.

Referring now to FIG. 9B, while in the second position, the lug 290 may be rotated into the base 22 and does not engage any portion of the projection 142. When the lug 290 is rotated to the second position, the lug 290 is positioned within the base 22 and does not overlap with any of the tabs 146. Stated another way, while the coupler 286 is in the second position, the lug 290 does not engage the tabs 146 and therefore allows the storage containers 14 to be unlocked and separated from one another substantially along the stacking direction D1.

Figure 10A:
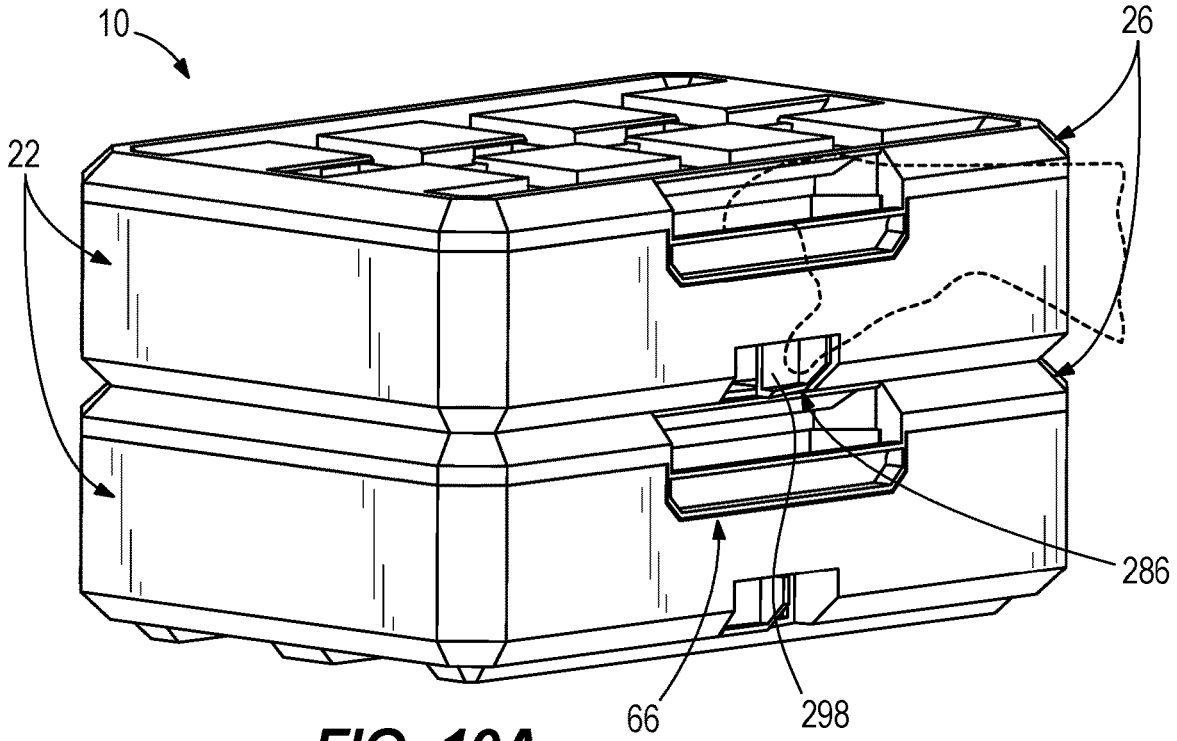
FIG. 10A is a perspective view illustrating operation of the latching mechanism of FIG. 9A before separation of a storage element away from another storage element.
Figure 10B:
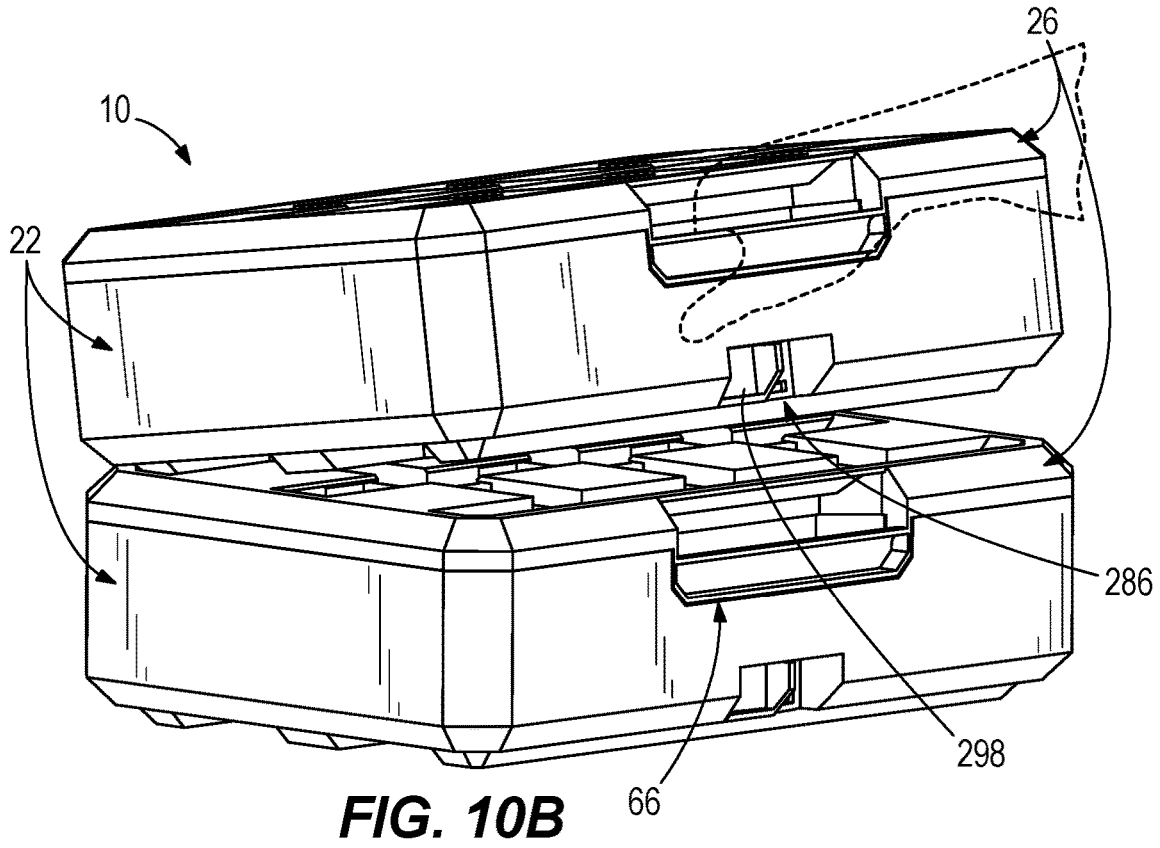
FIG. 10B is a perspective view illustrating separation of a storage element away from another storage element.

Referring now to FIGS. 10A and 10B, the latch 286 is configured to be rotatable from the first position, against the biasing force exerted by the biasing member 306, toward the second position. In the illustrated embodiment, the latch 286 may be biased toward the first position in order to secure the storage containers 14 together and/or to facilitate quick connection between the storage containers 14. In some embodiments, the latch 286 is positioned to facilitate actuation of the latch 286 by the same hand that grasps the handle 66 (for example, a user may grasp the handle 66 with a palm and fingers and operate the lever 298 with a thumb to move the latch 286 against the biasing force). Once the latch 286 is moved to the second position, the storage containers 14 may be separated relative to one another generally along the stacking direction D1. After the containers 14 have been separated, the lever 298 is released and may move back to the first position.

Figure 11A:
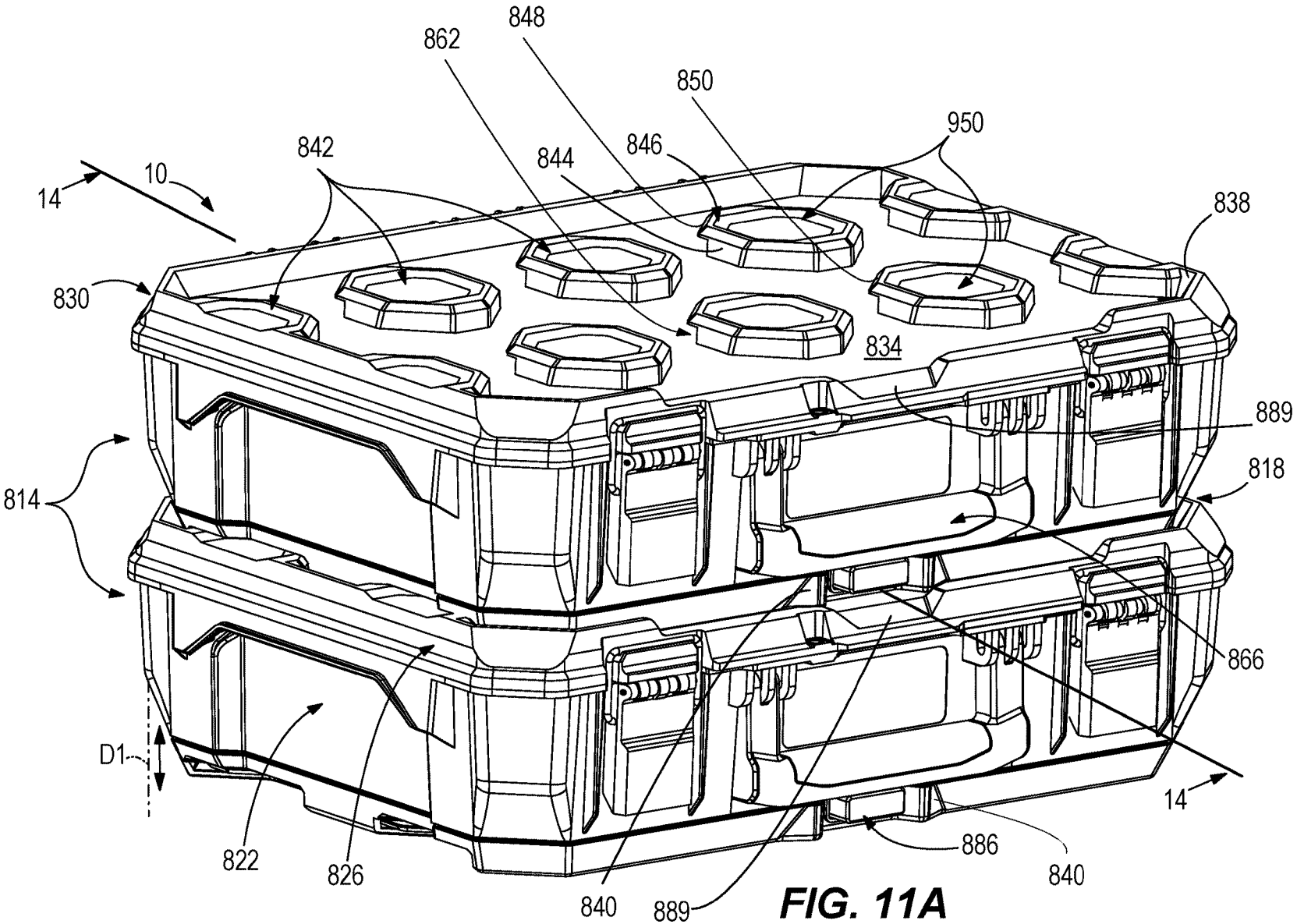
FIG. 11A is an upper perspective view of a stackable storage system according to another embodiment.

FIGS. 11A-15C illustrate a storage container 814 according to another embodiment. The storage container 814 includes a base 822 and a lid 826 pivotably coupled to the base 822 by a hinge 830. In the illustrated embodiment, an upper surface of the lid 826 includes a surface 834, such as a depressed surface in some embodiments, at least partially surrounded by a peripheral lip 838. In the illustrated embodiment, the lip 838 extends upwardly from the surface 834 and limits relative sliding and/or rotation between toolboxes 814 when stacked. As illustrated in FIGS. 11A and 11B, the lip 838 may include one or more locating features, such as a tab 840 or a notch 889, for ensuring that the storage containers 814 are positioned in a desired orientation relative to one another. In other constructions, the locating features may be arranged on another part of the storage container 814 (e.g., base 822). In some embodiments, the tab 840 may be formed as a plurality of tabs, and the notch 889 may be formed as a plurality of notches.

The lid 826 includes a plurality of projections 842 that extend from the surface 834 along the stacking direction D1. As best shown in FIG. 11C, each of the projections 842 includes a base 844 and an overhanging portion or tab 846 that is supported on the base 844 of each projection 842. The tab 846 extends outwardly from the projection 842 across the stacking direction D1 in a direction parallel to the surface 834 and spaced apart from the surface 834 with respect to the stacking direction D1, forming a space or gap 862 between the tab 846 and the surface 834 having a depth along the stacking direction D1. A first side and/or a second side of each projection 842 may also include a plurality of tabs 846 extending from the associated base 844 in multiple directions and oriented in a plane that is transverse (e.g., normal) with respect to the stacking direction D1. Some of the projections 842 and/or tabs 846 may be contiguous with the peripheral lip 838.

In the illustrated embodiment, the base 844 of each projection 842 has an octagonal-shaped profile, and a tab 846 extends from an oblique side 848 of the base 844 that is oriented at an oblique angle relative to a front surface of the container 814, and the gap 862 therefore is oriented along an oblique angle. In the illustrated embodiment, a straight portion or tooth 849 is positioned between oblique side 848, and the overall projection 842 may have an octagonal-shaped profile. In some embodiments, the base and/or the projection may include only the oblique sides 848, thereby having a rhomboid (e.g., diamond) shaped profile. In still other embodiments, the base and/or projection may have a different shape.

In the illustrated embodiment, the container 814 includes a plurality of projections 842 in a grid pattern including two rows of three projections each, as well as two "half" projections formed integrally with the lip 838. In other embodiments, the container 814 may include fewer or more rows and/or fewer or more projections in each row. In still other embodiments, the lid may be omitted from the container 814, and the base may be formed to include a lip including one or more projections 842 such that the base can still be stacked and secured to another storage container 814.

Each tab 846 includes an inclined or ramped surface 850 that is inclined in a direction away from the stacking direction D1. In the illustrated embodiment, the ramped surface 850 is provided on a top portion of the tab 846 to allow sliding of components on the base 822. In other embodiments, the ramped surface may be positioned on a different portion of the tab, and in still other embodiments, the tab may be formed without a ramped surface.

Figure 12:
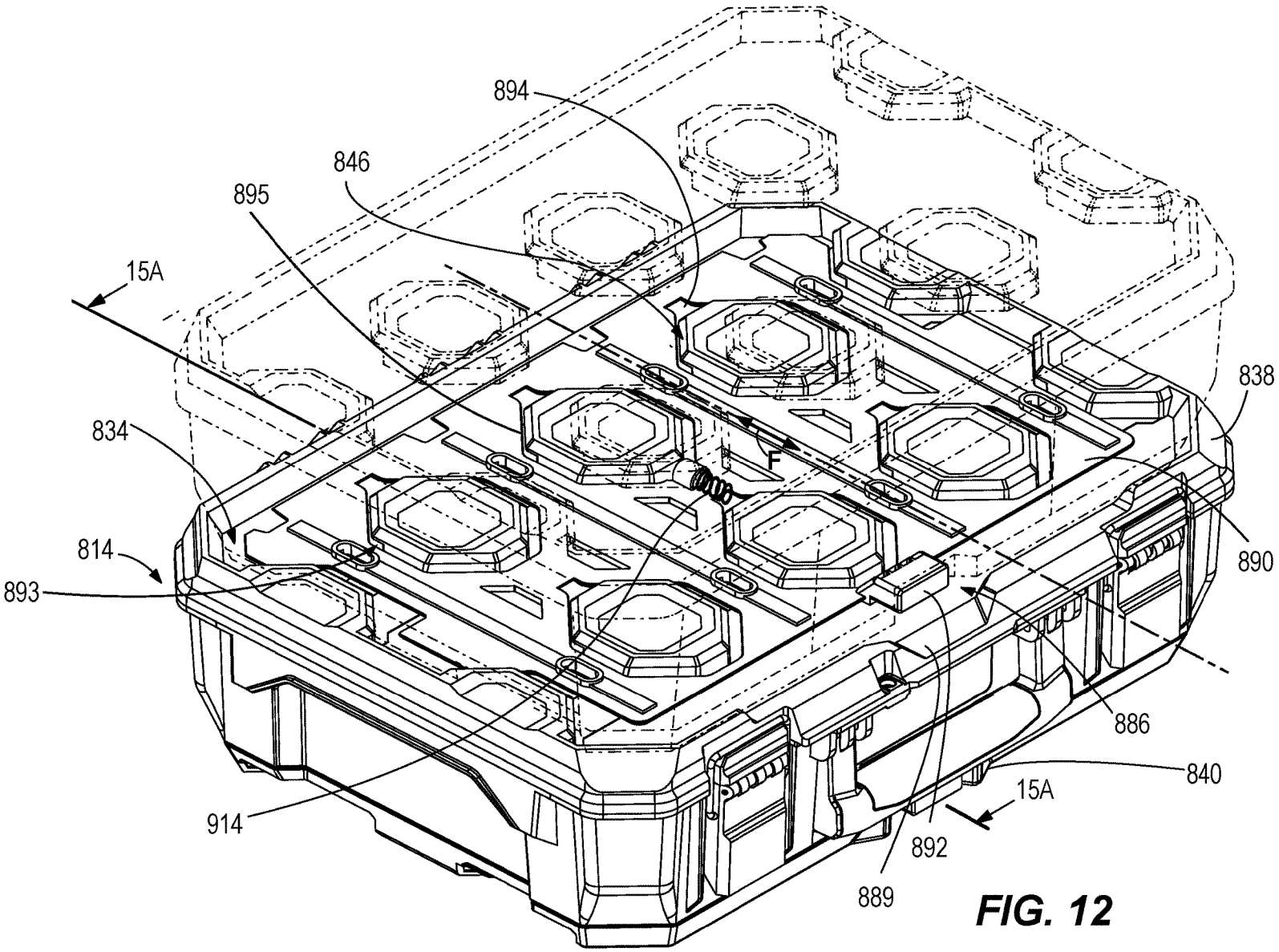
FIG. 12 is a perspective view of the storage system of FIG. 11A with a portion of an upper container hidden to show a latching mechanism within the upper container.

With continued reference to FIGS. 11A and 12, each tab 846 of each projection 842 extends outwardly toward adjacent projections 842. The projections 842 may be arranged symmetrically across a center axis of the container 814 and/or a center axis of a specific projection 842. Such arrangement may advantageously allow for stacking of storage containers with different dimensions. Stated another way, the arrangement of the projections 842 is symmetric about multiple points on the lid 826 such that smaller or larger containers having a complementary mating interface 818 (FIG. 16) may be stacked and secured on the lid 826. In this way, more than one container may also be stacked over the lid 826 (e.g., two smaller containers may be stacked over lid 826, three smaller containers may be stacked over lid, and/or the like).

Figure 11B:
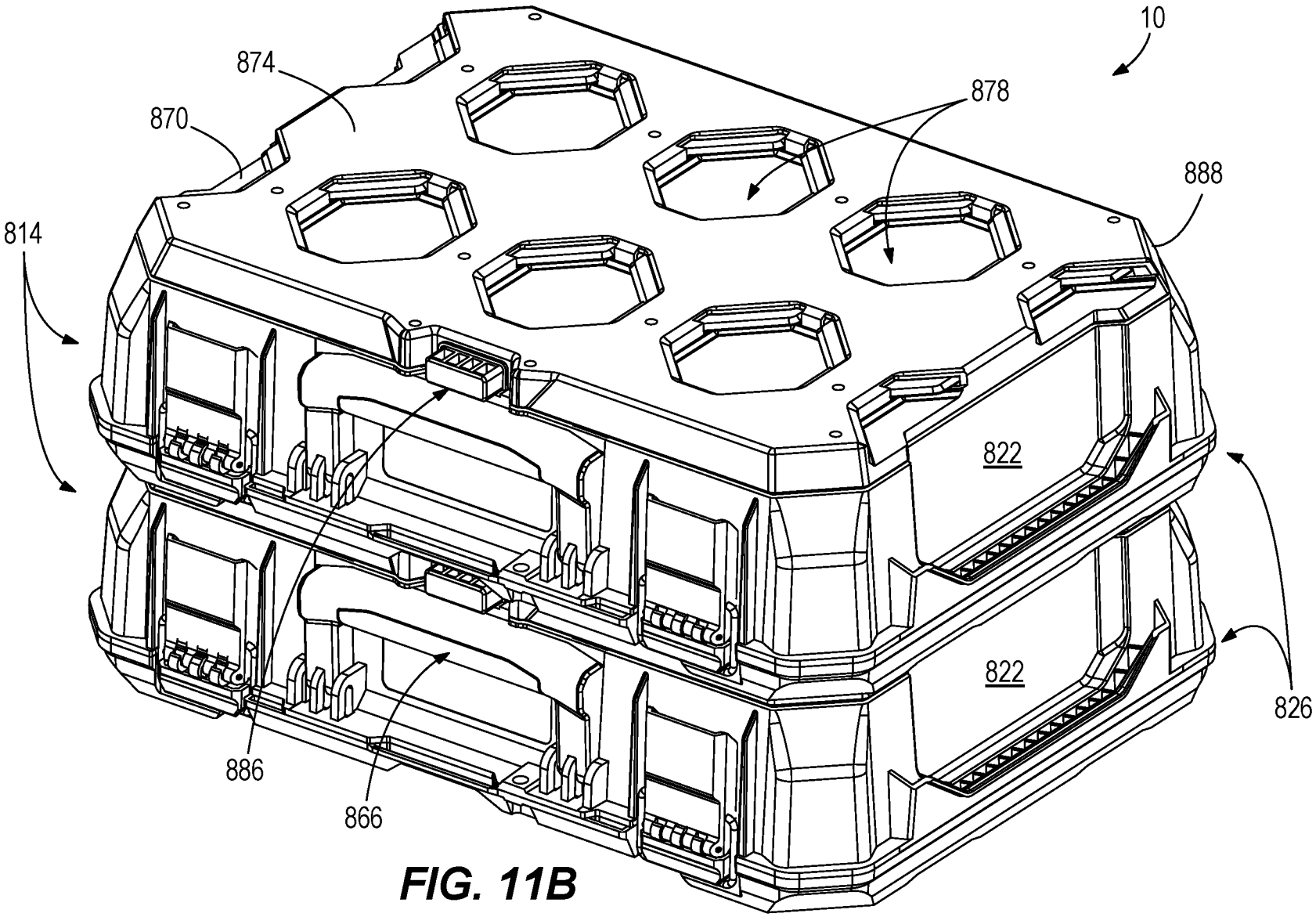
FIG. 11B is a lower perspective view of the storage system of FIG. 11A.
Figure 11C:
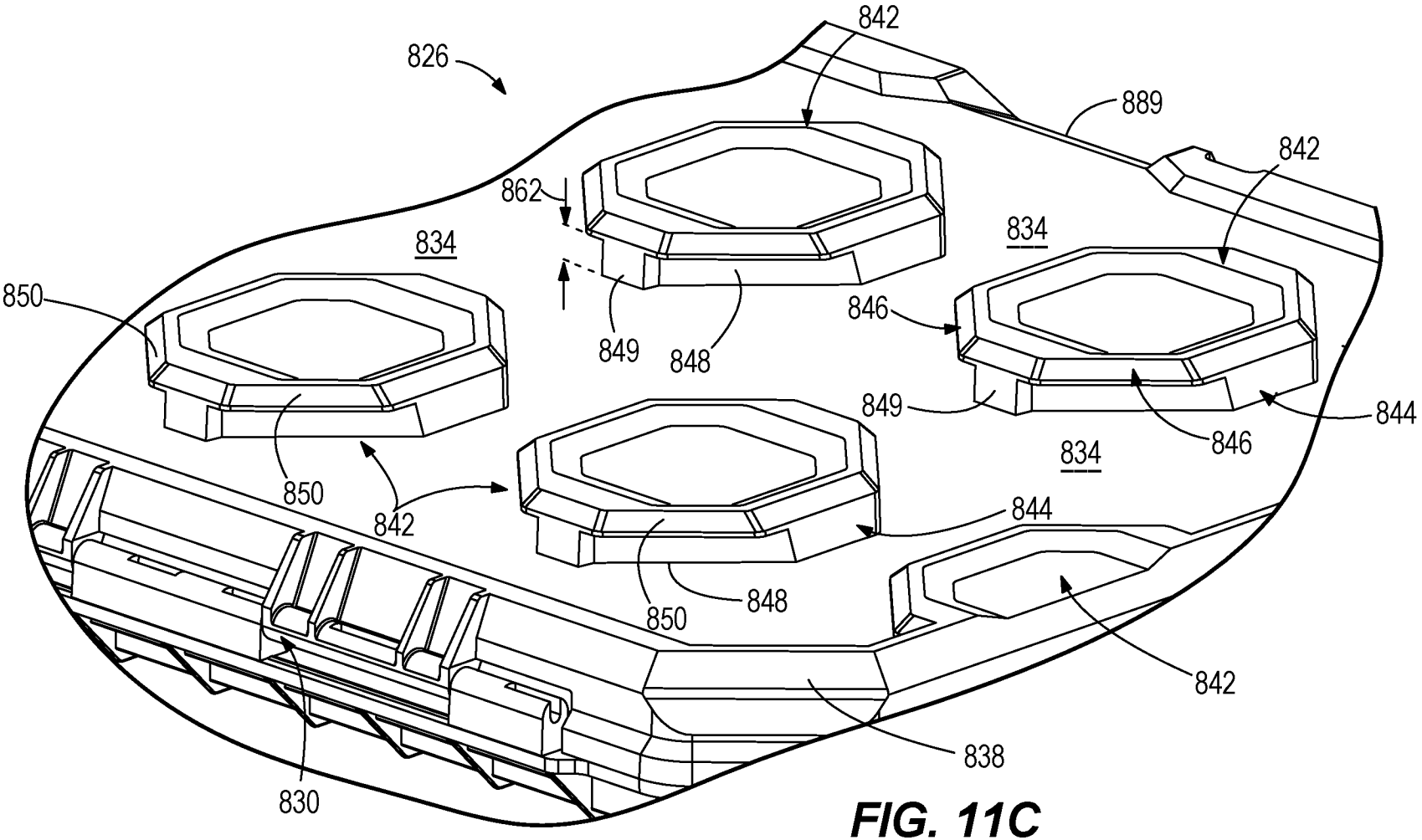
FIG. 11C is an enlarged perspective view of a portion of the upper surface of FIG. 11A.
Figure 13:
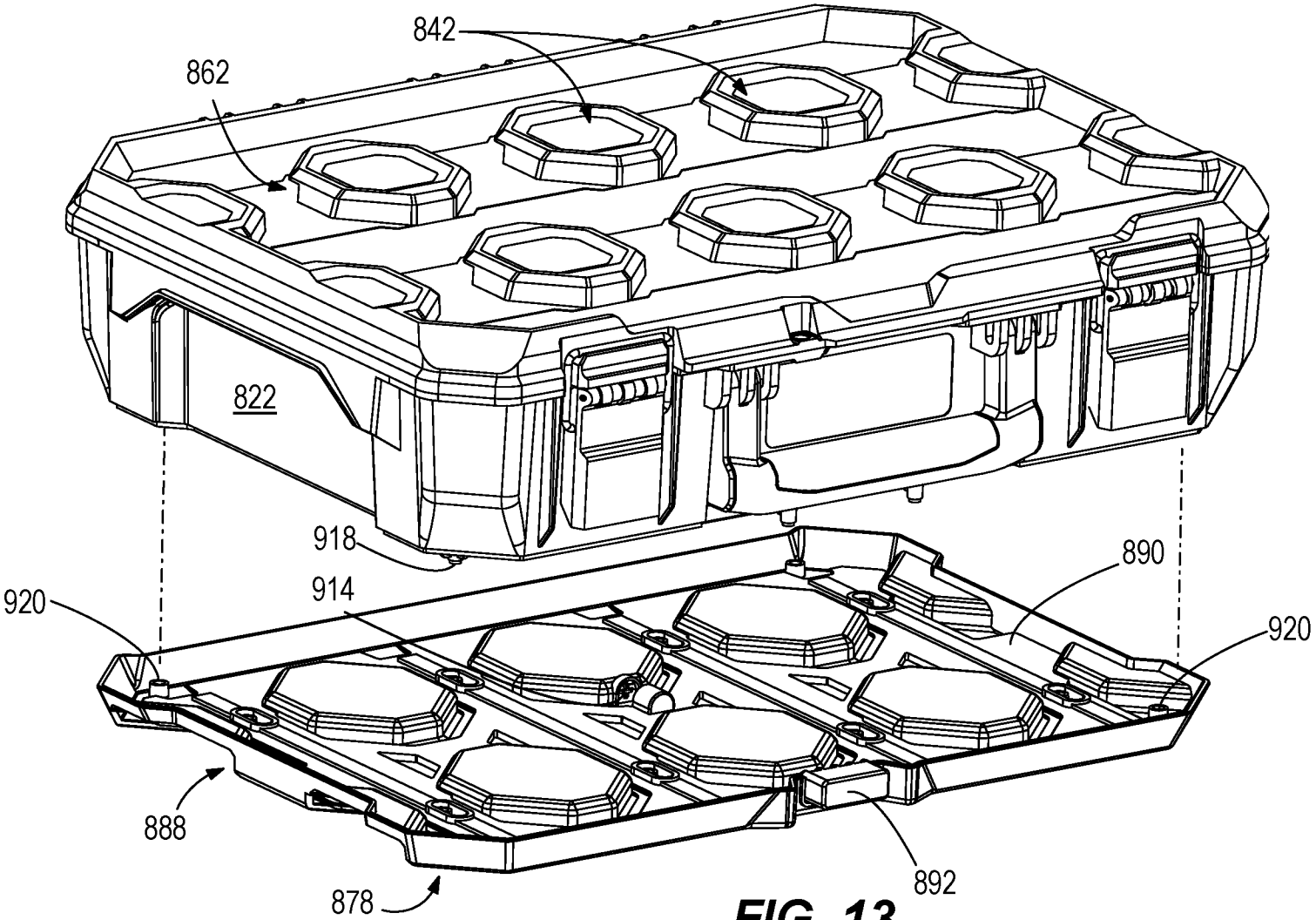
FIG. 13 is partially exploded perspective view of a single container of the storage system of FIG. 11A.

As illustrated in FIGS. 11A and 11B, the base 822 includes a handle 866, a first surface 870, a second surface 874 offset from the first surface 870, recesses or pockets 878 that correspond to the projections 842, and a coupling/latching assembly 886. The handle 866 may be formed as part of the base 822 or mounted thereon to accommodate handling and/or carrying of a single storage container 814 or multiple storage containers 814 secured to one another. In the illustrated embodiment, the first surface 870, second surface 874, pockets 878, and latch 886 may be formed as a part of the base 822 or may alternatively be formed on a bottom plate 888 (FIGS. 13 and 14). The bottom plate 888 may be formed separately from the base 822.

Each pocket 878 is configured to receive an associated one of the projections 842. In addition to the projections 842 and the pockets 878, the mating interface 818 between the storage containers may include engagement between other complementary features, such as the lip 838 or the first surface 870. In some embodiments, the first surface is not continuous across the base; for example, portions of the first surface 870 of the base 822 may be planar and positioned around a periphery of the second surface 874 and within the second surface 874 (e.g., pockets 878). For example, as illustrated in FIG. 11B, the first surface 870 may form a terminating surface/portion of the pockets 878. In the illustrated embodiment, the pockets 878 provide a first coupling portion and the projections 842 provide a second coupling portion.

When a first and second container 814 are aligned and stacked relative to one another, the surface 834 is oriented in a facing relationship with the second surface 874 and/or the first surface 870. In the illustrated embodiment, adjacent storage containers 814 are stackable at the mating interface 818, and the pockets 878 of one storage container 814 (e.g., an upper container) receive the projections 842 of another storage container 814 (e.g., the lower container). Stated another way, the first coupling portion may be positioned around the second coupling portion at the mating interface 818. The latch 886 is configured to move to a position that overlaps the first coupling portion and the second coupling portion (e.g., though an aperture or opening formed in the pockets 878) to selectively lock the containers 814 together. Rather than providing direct locking engagement between the first coupling portion of one container and the second coupling portion of the other container, the latch 886 provides an intermediate structure that overlaps and engages both the first coupling portion and the second coupling portion to secure the containers 814 together.

In addition, the notch 889, as illustrated in FIG. 11A, may be positioned in a portion of the lid 826 to engage the tabs 840, as illustrated in FIG. 11B, of another container 814 when the containers 814 are stacked relative to one another in a desired orientation. The notch or notches 889 may be elongated, recessed, or the like. In the illustrated embodiment, the notch 889 is formed on the lid 826 (i.e., in lip 838) in a position adjacent the latch 886 of an adjacent container 814 when containers 814 are stacked. The tab 840 may extend from the base 822 of the container 814 to align with and/or engage the notch 889 to complement the function of the locating features.

As illustrated in FIGS. 11A and 11B, a portion of the lip 838 adjacent the hinge 830 does not include a notch or recess, which thereby inhibits storage containers 814 from being stacked in an undesired orientation (e.g., facing opposite directions). Stated another way, the notch 889 and tab 840 together may prevent the storage containers 814 from being stacked in an unwanted or undesired configuration. In other embodiments, the storage containers 814 may include other locating features to ensure proper alignment of stacked containers 814.

The various complementary surfaces of the lid 826 and the base 822 are configured to limit sliding and/or rotation between toolboxes 814 when stacked. The various complementary surfaces also advantageously prevent the lid 826 and base 822 or opposing stacked containers 814 from shifting relative to one another in the direction parallel to the surface 834. In this way, the containers 814 are more stable when stacked and are less likely to become unstacked during use and/or transportation. Stated another way, relative movement in a direction normal to the stacking direction D1 between containers 814 is prohibited, prevented, or otherwise minimized while the containers 814 are stacked along the stacking direction D1.

Referring now to FIGS. 12 and 13, the coupler or latch assembly 886 includes a locking member 890 (e.g., a plate, tab, arm, and/or the like) and an actuator or button 892. The button 892 is movable by a user to move the locking plate 890 relative to the base 822 in a direction along axis F, which may be parallel to the surface 834, in one embodiment by way of example. The locking plate 890 may be supported in the base 822 (e.g., in the bottom plate 888, FIG. 13). The latch assembly 886 is supported such that when the base 822 of one container 814 is stacked on the lid 826 of the other container 814, the locking plate 890 is oriented in a plane parallel to a lower surface of the base 822 and/or bottom plate 888, and the locking plate 890 is selectively movable to be positioned between the surface 834 and the tab 846 (i.e., movable in the gap 862).

Figure 14A:
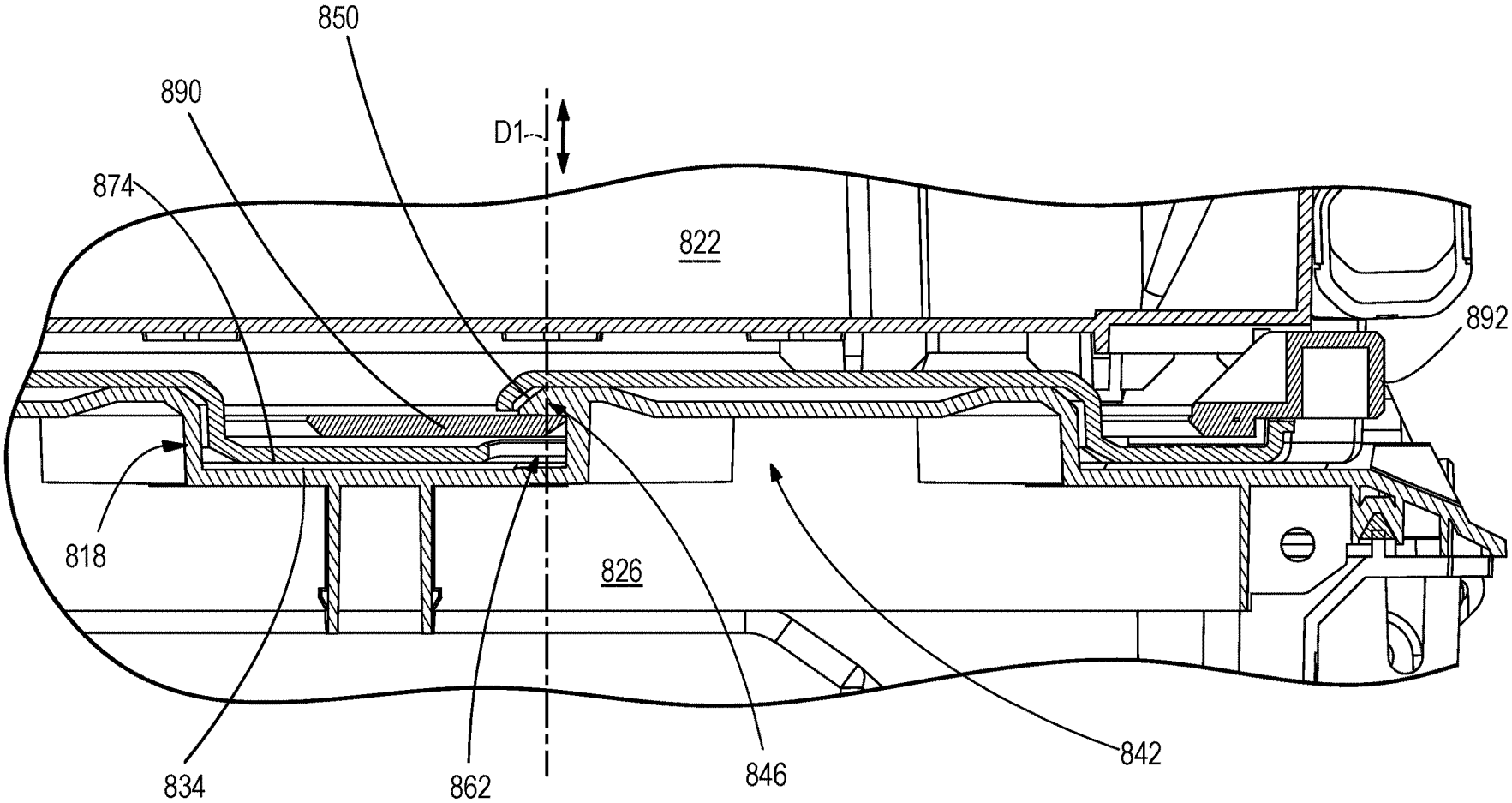
FIG. 14A is a cross-sectional view of the stackable storage system of FIG. 11A, viewed along section line 14-14, with the latching mechanism of an upper storage container in an engaged position with a lower storage container.
Figure 14B:
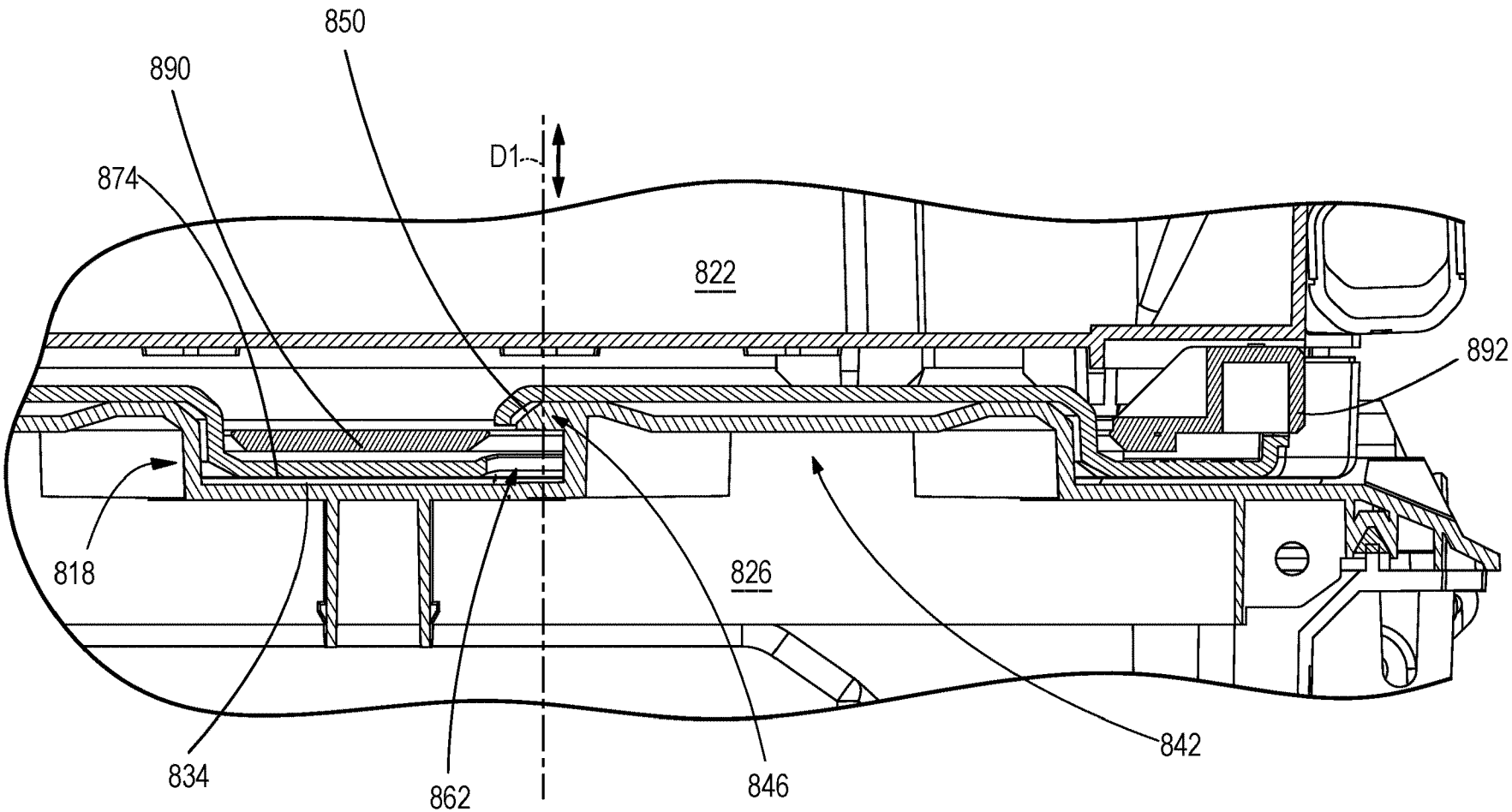
FIG. 14B is a cross-sectional view of the stackable storage system of FIG. 11A, viewed along section line 14-14, with the latching mechanism of the upper storage container in a disengaged position.

As shown in FIGS. 12-14B, in the illustrated embodiment, the locking plate 890 includes openings 893 and a stop or seat 894. The openings 893 may include oblique edges 895, although non-oblique edges are contemplated. The locking plate 890 may be moved relative to the base 822 and lid 826 along the direction parallel to the surface 834 between a first, "locked", or engaged position (FIG. 14A) in which the base 822 and lid 826 are prevented from separating and a second, "unlocked", or disengaged position (FIG. 14B). In the engaged position (FIG. 14A), edges (e.g., oblique edges 895) of the openings 893 are positioned in the gaps 862 between the tabs 846 and the surface 834 of the lower storage container 814 to prevent separation of the lower container 814 from the base 822 of the upper container. Additionally, the seat 894 may receive the tooth 849 while the locking member 890 is in the engaged position.

In the disengaged position (FIGS. 12 and 14B), the openings 893 are aligned with the pockets 878, permitting the projections 842 to be removed from the pockets 878. Stated another way, the locking plate 890 is moved out of the pocket 878 and does not engage the tabs 846. In addition, the seat 894 does not engage the tooth 849 while the locking plate 890 is in the disengaged position. As best illustrated in FIGS. 14A and 14B, the locking plate 890 is an intermediate member arranged separately from the pockets 878 and projections 842 and is moveable independently from the base 822 and/or lid 826 of adjacent containers 814 to selectively lock and unlock containers 814 together. Stated another way, the locking plate 890 is configured to lock containers 814 together by being positioned between portions of a lid 826 and an adjacent base 822, thereby avoiding the need to provide direct engagement (e.g., by overlapping flanges) between portions of the containers 814 to secure the containers 814 together.

In the illustrated embodiment, the oblique edges 895 of the locking plate 890 may be positioned to engage rear tabs 846 of the projections 842 (i.e., edges of the projections 842 facing away from the handle 866). In some embodiments, the locking plate 890 is biased by a biasing force (e.g., by a spring 914) or another force (e.g., a pushing force, a pulling force, and/or the like acting against a biasing member) toward the engaged position, regardless of whether the storage containers 814 are stacked relative to one another. In the illustrated embodiment, the locking member 886 is biased toward a center of the storage containers 814 to the engaged position in order to secure the storage containers 814 together and/or to facilitate quick connection between the storage containers 814.

The inclined surfaces 850 on the projections 842 allow a sliding contact-type connection between the locking plate 890 and the inclined surfaces 850 as multiple storage containers 814 are being stacked relative to one another. As the storage containers 814 are brought into contact with one another, the locking member 890 slides along the ramped surface 850 to translate the locking member 890, against the biasing force, toward the second position. Once the locking member 890 moves past the ramped surface 850, the latch 886 releases, and the latch 886 moves to the first position.

As illustrated in FIGS. 13, 14A, and 14B, the locking member 890 and biasing member 914 (FIG. 13) may be arranged between the base 822 and the bottom portion 888. The base 822 may also include feet 918 formed on the bottom part of the base 822. The feet 918 may align with cavities 920 that are formed in the bottom portion 888. In the illustrated embodiment, the bottom portion 888 may be secured to the base 822 by removably fastening the feet 918 of the base in the cavities 920 of the bottom plate 888. In another embodiment, the base 822 and bottom portion 888 may be formed as a single piece with the locking member 890 and biasing member 914 arranged therebetween. In yet another embodiment, the locking member 890 and biasing member 914 may be arranged in another manner.

As described above with reference to the latch 86 and storage containers 14, the storage containers 814 are similarly separable through translation along the stacking direction D1 while the latch 886 and locking member 890 are in the second position. During a stacking operation of adjacent containers 814, one container 814 is placed on top of another container 814 such that the adjacent containers 814 engage one another at the mating interface 818 and are commonly oriented (FIG. 11A). A force exerted along the stacking direction D1 (e.g., by the user, or due to the weight of the upper container 814, and/or both) may cause the ramped surfaces 850 of the projections 842 to move the locking member 890 against the biasing force toward the second position. Once the adjacent containers 814 are brought close enough together for the locking member 890 to move past the tab 846 and inclined surface 850, the locking member 890 is urged by the biasing member 914 to at least partially extend into the gap 862 (i.e., first position) and engage against portions of both containers 814 thereby locking the containers 814 together. As best illustrated in FIGS. 14A and 14B, stacked containers 814 are locked together through engagement made by the locking member 890 of one container 814 being positioned to contact a fixed or rigid structure of another container 814 (i.e., tab 846). Stated another way, the structures of each container that facilitate locking engagement are fixed and do not overlap one another. Rather, locking engagement is provided by the locking member 890 overlapping the fixed structures of both containers 814.

During a separating operation of adjacent containers 814, the user actuates the latch 886 (e.g., via pushing or pulling the latch) across the stacking direction D1 (e.g., in a plane normal to the stacking direction D1, etc.) opposite the biasing force to remove the locking member 890 from the gap 862 (i.e., second position), thereby releasing the adjacent containers 814 from one another. In order to move the locking member 890 from the first position to the second position, a user engages (e.g., pushes, pulls, slides, rotates, and/or the like) the button 892 of the latch assembly 886. In some embodiments, the latch assembly 886 is positioned to enable the locking member 890 to be moved by the same hand that grasps the handle 866 (for example, the user's fingers can move the locking member 890). The user's fingers can move the latch 886 against the biasing force (e.g., to counteract the biasing force) while leveraging the user's hand against the handle 866. Once the storage containers 814 are released from one another, the adjacent containers 814 may be separated along the stacking direction D1 (e.g., by lifting an upper container away from a lower container). After the containers 814 have been separated, the locking member 890 may move to the first position by way of the biasing force.

Figure 15A:
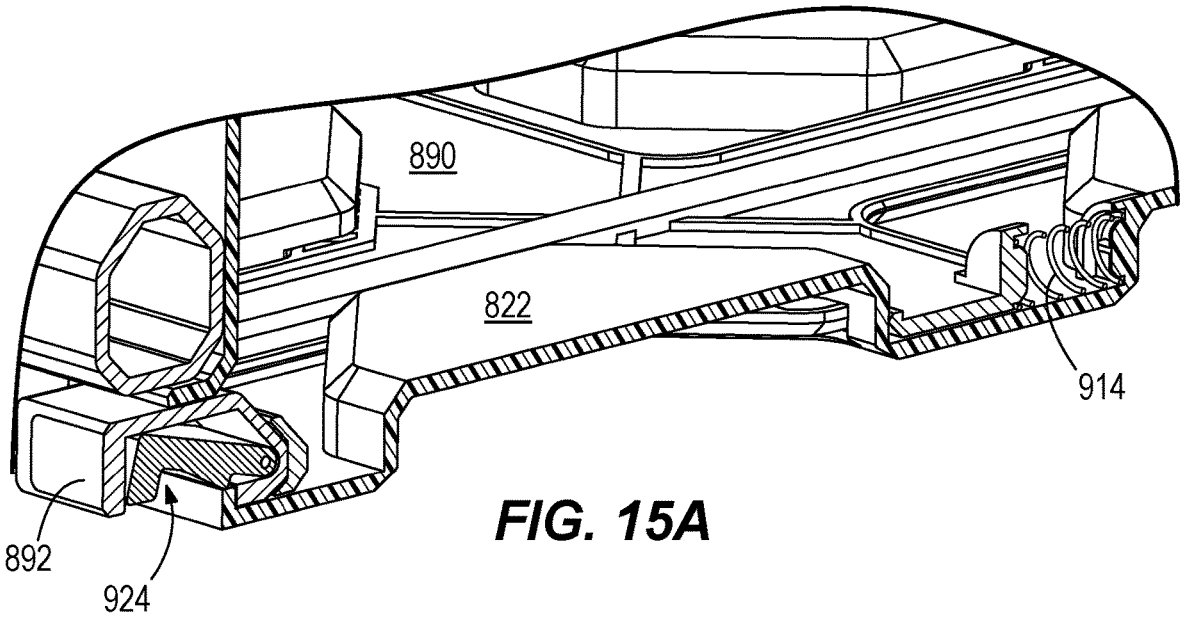
FIG. 15A is a cross-sectional view of the container of FIG. 12 viewed along section line 15A-15A, illustrating a latching mechanism according to another embodiment in an engaged position.
Figure 15B:
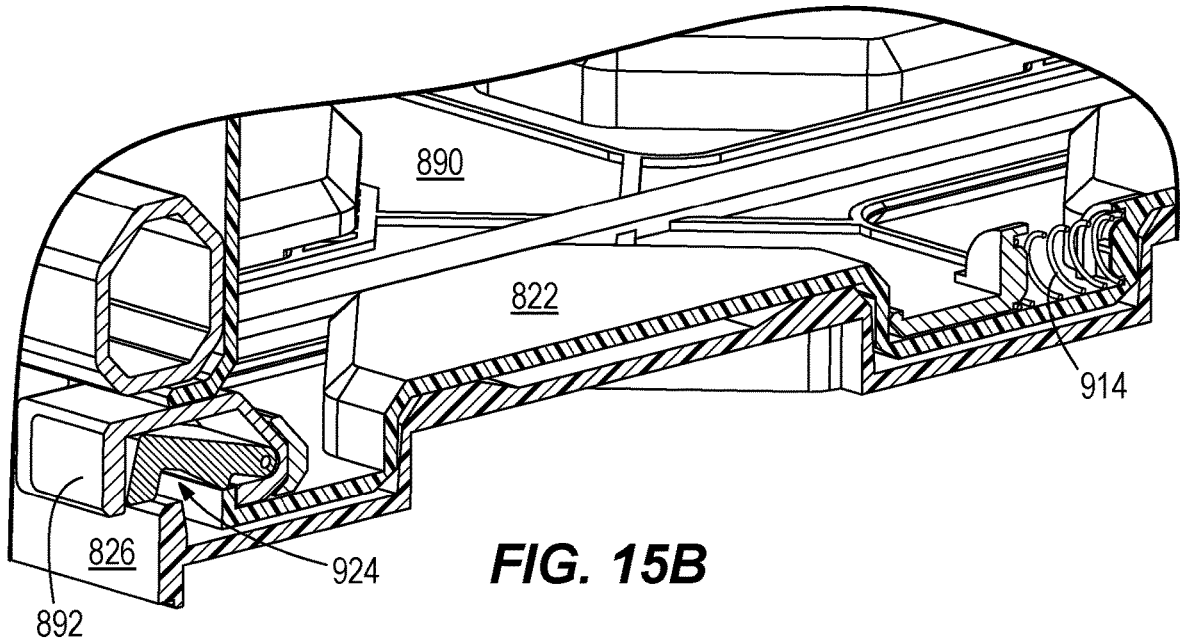
FIG. 15B is the cross-sectional view of FIG. 15A illustrating the latching mechanism in an intermediate disengaged position.
Figure 15C:
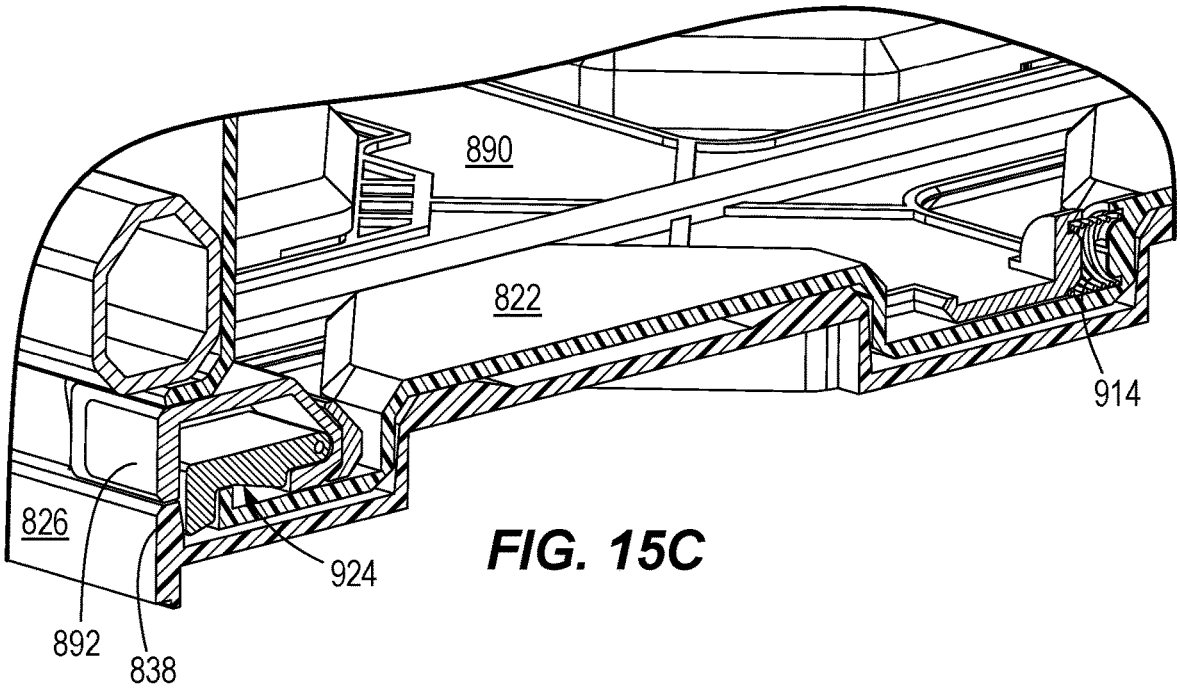
FIG. 15C is the cross-sectional view of FIG. 15A illustrating the latching mechanism in a locked disengaged position.
Figure 15D:
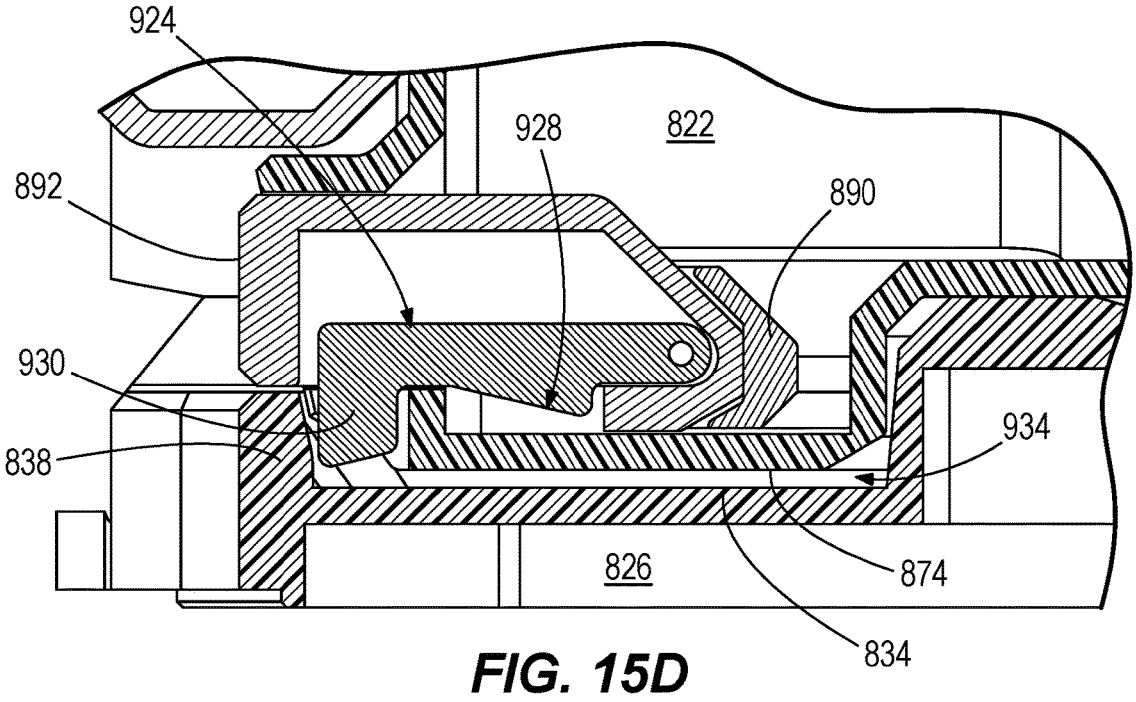
FIG. 15D is a cross-sectional side view of the latching mechanism of FIG. 15C.

Referring now to FIGS. 15A-D, in some embodiments the locking plate 890 may rest in the first/engaged position (FIG. 15A), may be intermediately or momentarily maintained in the second/disengaged position (FIG. 15B) in which the base 822 and lid 826 may be separated from one another while the plate 890 is held by a user (i.e., by pressing the button 892), and may be selectively locked in the third/disengaged position (FIGS. 15C and 15D). The latch assembly 886 may further include a secondary coupler or latch 924 moveably supported within the press button 892. The secondary latch 924 may include a ramp portion 928 and a hook portion 930.

In the illustrated embodiment shown in FIGS. 15C and 15D, the latch assembly 886 may be held in the third position while the base 822 of one container 814 is stacked on the lid 826 of another container 814. Once the button 892 has been actuated (e.g., moved by a user) to move the locking member 890 into the third position (e.g., by pressing the button 892 further), a front surface of the hook portion 930 contacts an inside portion of the lip 838 to hold the locking member 890 in place while the base 822 and lid 826 are stacked. Stated another way, while the locking member 890 is in the third position and the base 822 is stacked on the lid 826, the secondary latch 924 is constrained against the lip 838 via the biasing force provided by the biasing member 914.

Once the base 822 is lifted away from the lid 826, the lip 826 no longer constrains the secondary latch 924 in position against the biasing force, and the locking member 890 is free to move back into the first position. As storage containers 814 are stacked, the ramped portion 928 of the secondary latch 924 slides along a portion of and relative to the base 822 until the locking member 890 is received in the gap 862. The hook portion 930 simultaneously rises as the ramped portion 928 slides against the base 822, and the hook portion 930 rotates into contact with a front portion of the lid 826 once the locking member 890 is received in the gap 862.

With specific reference to FIG. 15D, an optional clearance space 934 is illustrated between the second surface 874 of the base 822 and the depressed surface 834 of the lid 826. The clearance space 934 may be provided, for example, to accommodate debris (e.g., dirt, dust, metal shavings, and/or the like) while still permitting the base 822 and the lid 826 to be stacked relative to one another. In the illustrated embodiment, the clearance space 934 may be about 1.5 mm. In other embodiments, the clearance space 934 may be more or less than 1.5 mm (e.g., 1 mm, less than 1 mm, and/or the like) or greater than 1.5 mm (e.g., between 1.5 and 5 mm, and/or the like). Although the clearance space 934 is illustrated between the second surface 874 and the surface 834, one or more clearance spaces may be positioned in other locations and/or omitted altogether.

Figure 16:
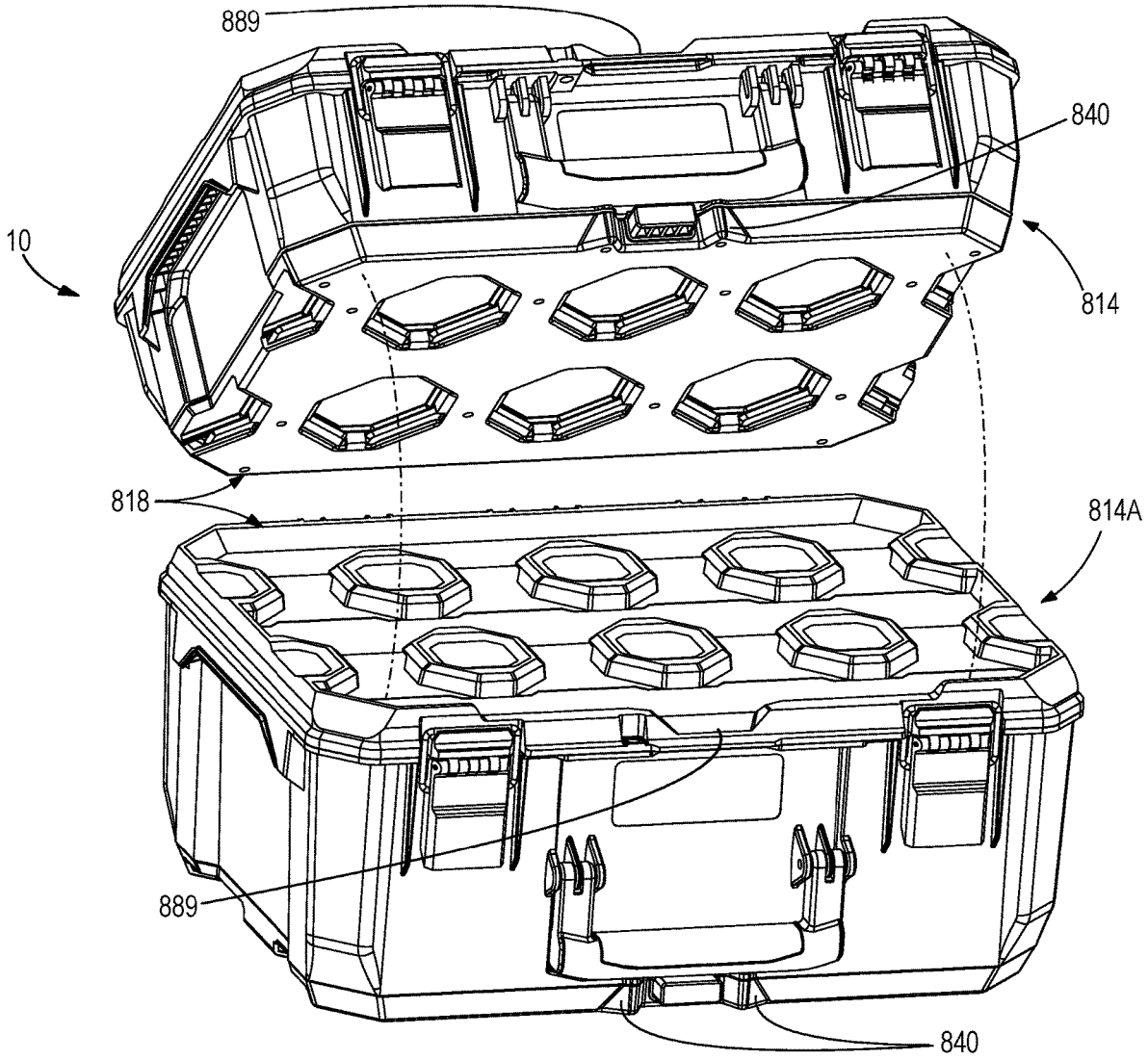
FIG. 16 is a perspective view of the single container of FIG. 13 positioned above a storage container according to another embodiment.

Referring now to FIG. 16, the storage system 10 may include one or more storage containers 814 each having a first depth and as well as one or more second storage containers 814A each having a second depth. As best illustrated in FIG. 16, the tabs 840 and notches 889 may be positioned on corresponding front portions of each container 814, 814A to prevent the containers 814, 814A from being stacked incorrectly (e.g., sideways relative to one another, backwards relative one another, and/or the like). As described above, each of the storage containers 814, 814A in the storage system 10 include at least some of the various complementary surfaces that make up the mating interface 818 between the containers 814, 814A. In other embodiments, the storage system 10 includes a large variety of stackable storage containers that each include the mating interface 818 or a portion of the mating interface 818.

Figure 17:
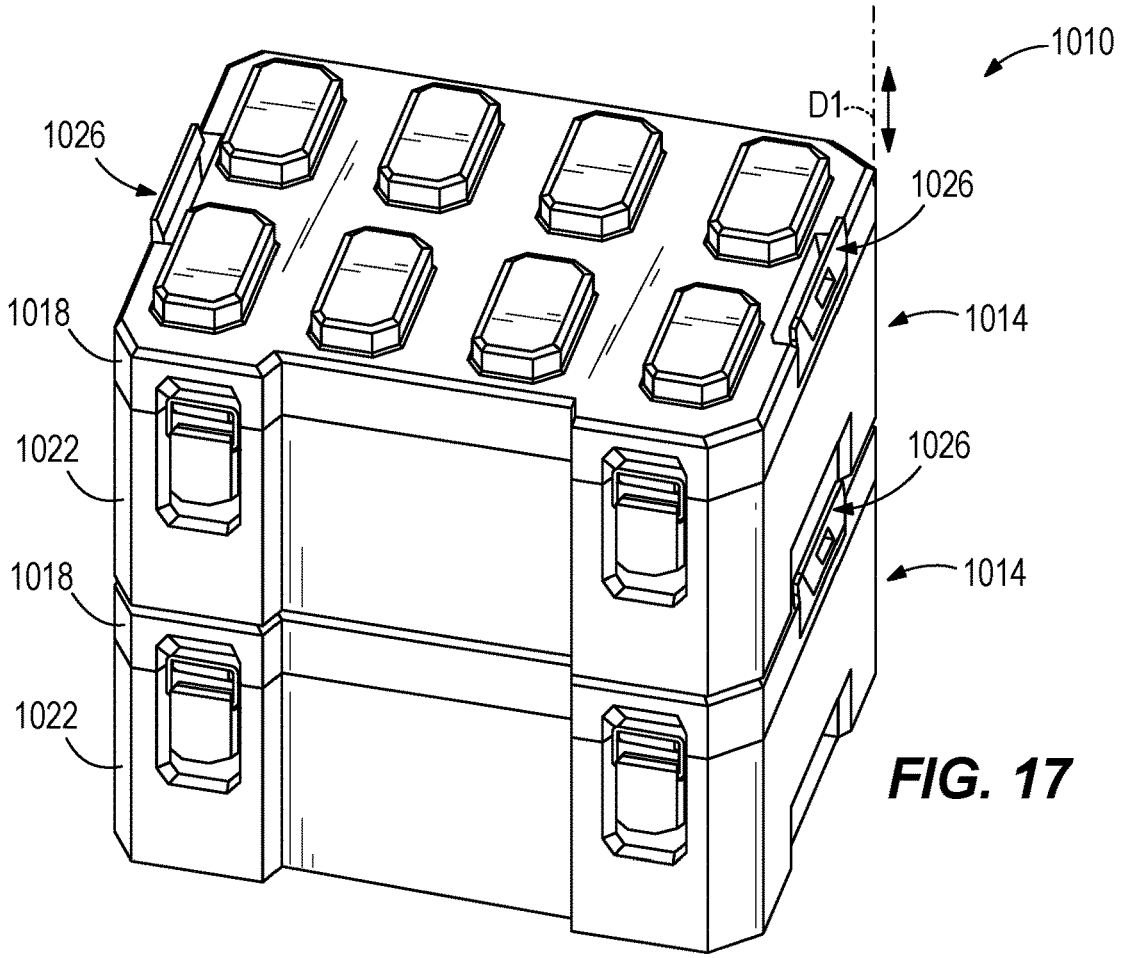
FIG. 17 is an upper perspective view of a storage system according to another embodiment.
Figure 18:
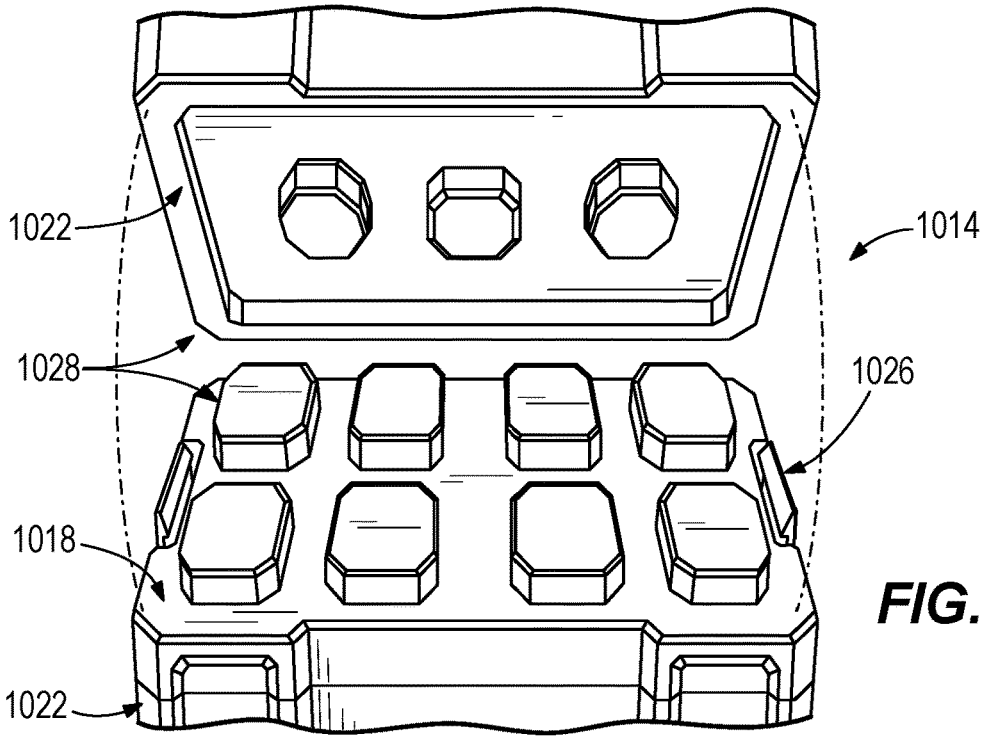
FIG. 18 is another perspective view of the storage system of FIG. 17 illustrating an interface between stackable storage containers.

FIGS. 17 and 18 illustrate another embodiment of a system 1010 for stacking and securing multiple storage containers 1014 (e.g., toolboxes, etc.) relative to one another. Each of the toolboxes 1014 includes a base 1022 and a lid 1018 pivotally coupled to the base 1022 and securable in a closed position. The system 1010 further includes an interface 1028 for mating complementary surfaces of the storage containers 1014 relative to one another. In the illustrated embodiment, the storage containers include a coupling assembly 1024 (e.g., rotatable latches 1026) to selectively attach the lid 1018 of one toolbox 1014 to the base 1022 of another adjacent toolboxes 1014 at the interface 1028.

As shown in FIG. 18, the mating interface 1028 includes a plurality of polygonal features (e.g., projections, raised areas, and/or the like) positioned on a lid 1018 of one toolbox 1014 that fit in a complementary manner with features (e.g., recesses, pockets, and/or the like) positioned on the base 1022 of an adjacent toolbox 1014. In the illustrated embodiment, the polygonal features include octagonal-shaped projections protruding from an upper surface of the lid 1018, and the base 1022 also includes octagonal-shaped projections that fit between the projections on the lid 1018. The toolboxes 1014 may be placed or stacked on one top of another such that the latches 1026 of both toolboxes 1014 align vertically. The latches 1026 may then be actuated to secure the toolboxes 1014 to one another. In the illustrated embodiment, the toolbox storage system 1010 includes two similar toolboxes 1014. In other embodiments, any number of toolboxes 1014 having the complementary surfaces of the interface 1028 may be stacked on one another. In such embodiments, the latches 1026 may be used to attach the any number of toolboxes 1014 to adjacent toolboxes 1014 in the toolbox storage system 1010.

Figure 20:
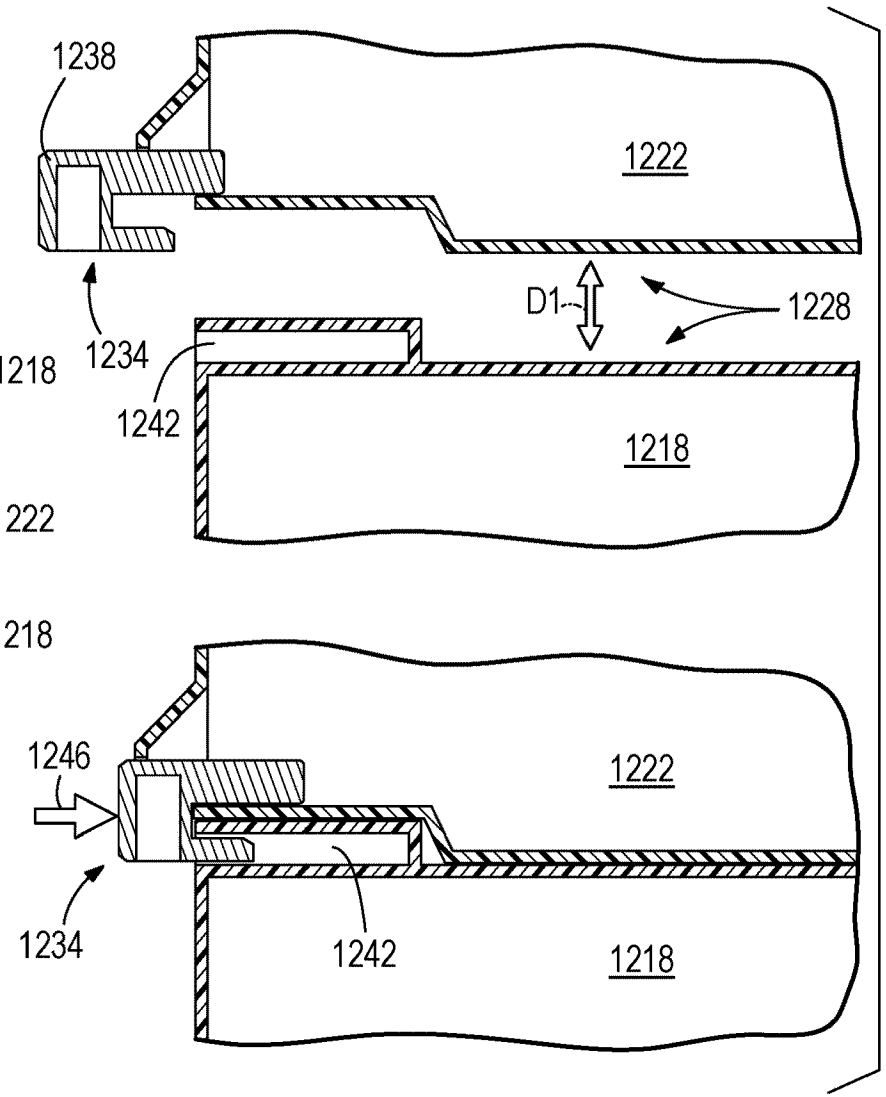
FIG. 20 is a side cross-sectional view of a coupling assembly of the storage system of FIG. 19, viewed along section 20-20.
Figure 19:
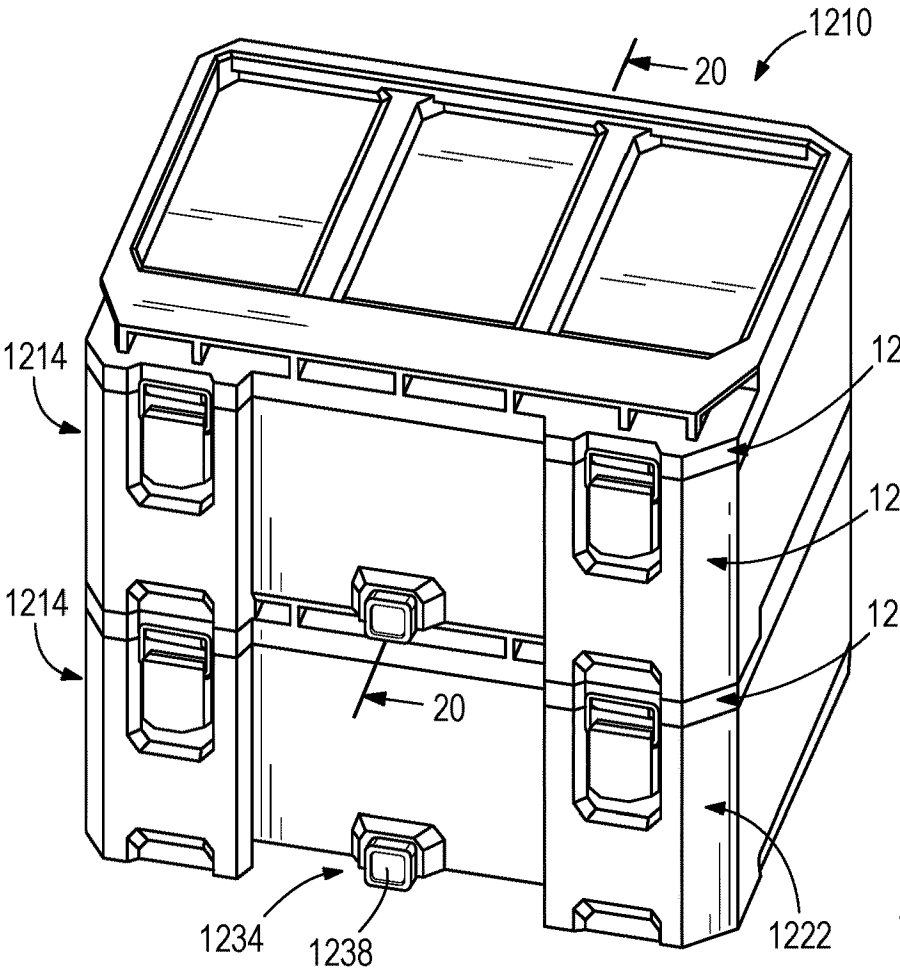
FIG. 19 is an upper perspective view of a storage system according to another embodiment.

FIGS. 19 and 20 illustrate a storage system 1210 according to another embodiment. The storage system 1210 includes at least two storage containers 1214 (e.g., toolboxes, etc.) stackable and securable to one another. Each of the toolboxes 1214 includes a base 1222 and a lid 1218 pivotally coupled to the base 1222. The system 1210 further includes an interface 1228 for mating complementary surfaces of the storage containers 1214 relative to one another. In some embodiments, the interface 1228 may include flanges or tabs on one toolbox 1214 that interlock with feet, pockets, or the like, of another toolbox 1214. A shape of the flanges or tabs may be similar to the shape of the feet or pockets such that the interface 1228 allows for multiple toolboxes 1214 to be stacked and nested with one another.

Each of the toolboxes 1214 further includes a coupling assembly 1234 for locking the base 1222 of one toolbox 1214 to the lid 1218 of an adjacent toolbox 1214 at the interface 1228. In the illustrated embodiment, the coupling assembly 1234 includes an actuator 1238 extending from the base 1222 and a receiver 1242 extending into the lid 1218. In other embodiments, the coupling assembly 1234 could include other components, such as an actuator and receiver having different configurations. As illustrated in FIGS. 19 and 20, the actuator 1238 is a push-button, but other types of actuators 1238 such as a knob, lever, pull-tab, rotatable tab, dial, and/or or the like could be implemented.

As shown in FIG. 20, one toolbox 1214 may be stacked and nested on an adjacent toolbox 1214 at the interface 1228. Once the toolboxes 1214 have been nested and/or snapped together, a user may move the actuator 1238 in the direction of arrow 1246 to lock the toolboxes 1214 together. To unlock the toolboxes 1214 from one another, the user may move the actuator 1238 in a direction opposite of arrow 1246 to remove the actuator 1238 from the receiver 1242. Following separation of the actuator 1238 from the receiver 1242, the user may separate the toolboxes 1214 from one another.

Figure 22:
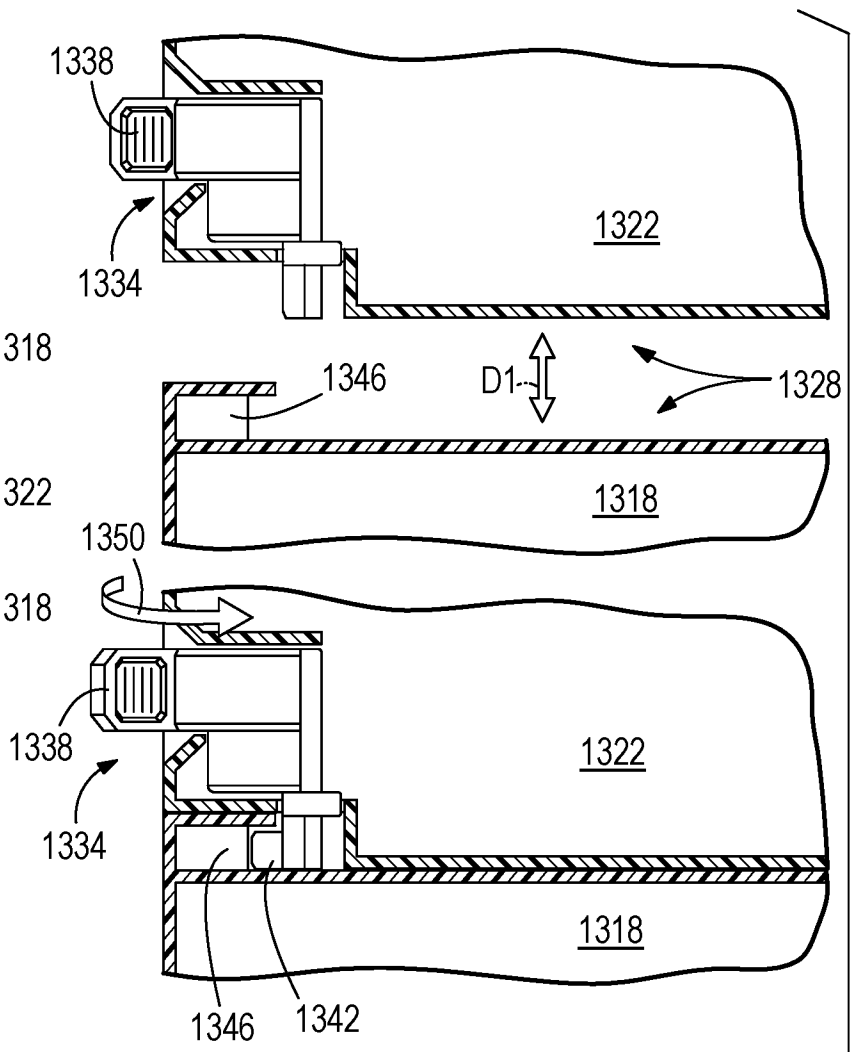
FIG. 22 is a side cross-sectional view of a coupling assembly of the storage system of FIG. 21, viewed along section 22-22.
Figure 21:
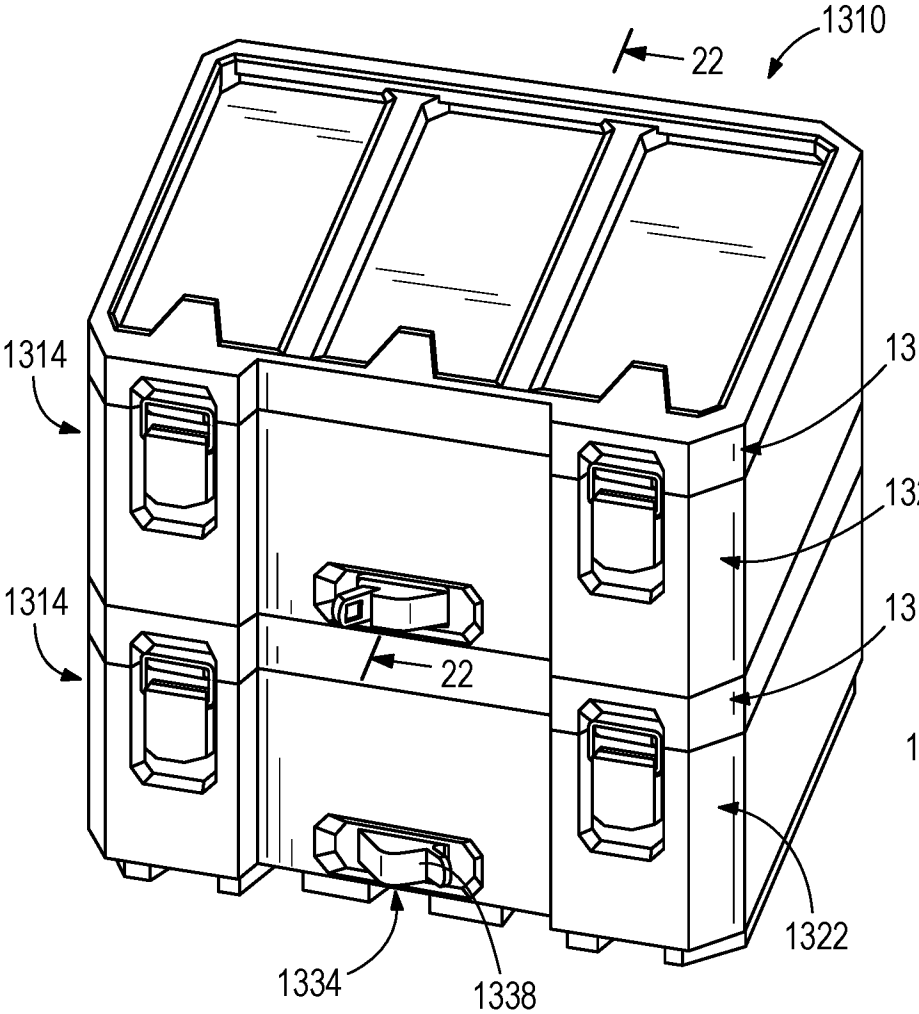
FIG. 21 is an upper perspective view of a storage system according to another embodiment.

FIGS. 21-23 illustrate a storage system 1310 according to another embodiment. The storage system 1310 includes at least two storage containers 1314 (e.g., toolboxes, etc.) stackable and securable to one another. Each of the toolboxes 1314 includes a lid 1318 and a base 1322 pivotally coupled to the lid 1318. The system 1310 further includes an interface 1328 for mating complementary surfaces of the storage containers 1314 relative to one another. In some embodiments, the interface 1328 may include flanges or tabs on one toolbox 1314 that interlock with feet, pockets, or the like, of another toolbox 1314. A shape of the flanges or tabs is similar to the shape of the feet or pockets such that the interface 1328 allows for multiple toolboxes 1314 to be stacked and nested with one another.

Each of the toolboxes 1314 includes a coupling assembly 1334 for locking the base 1322 of one toolbox 1314 to the lid 1318 of an adjacent toolbox 1314 at the interface 1328. The coupling assembly 1334 includes an actuator 1338, a latch 1342 formed on the base 1322, and a recess 1346 molded into the lid 1318. In other embodiments, the latch 1342 may be formed on the lid 1318 while the recess 1346 may be molded into the base 1322. In the illustrated embodiment, the actuator 1338 is at least partially situated within the base 1322 and is rotatable relative to the base 1322 and lid 1318.

The latch 1342 may be coupled to the actuator 1338 or integrally formed thereon to rotate with the actuator 1338 such that the latch 1342 is selectively received within the recess 1346. In operation of the actuator 1338, a user may manipulate a portion of the actuator 1338 that extends out of the base 1322 to operate the latch 1342 between a locked position (FIG. 23; Step 1A) and an unlocked position (FIG. 23; Step 3A). In the locked position, the latch 1342 of one toolbox 1314 is received in the recess 1346 on another adjacent toolbox 1314 to lock the base 1322 and lid 1318 of adjacent toolboxes 1314 together. In the unlocked position, the latch 1342 of one toolbox 1314 is not received in the recess 1346 on another adjacent toolbox 1314 such that the adjacent toolboxes 1314 may be separated from one another.

Figure 23B:
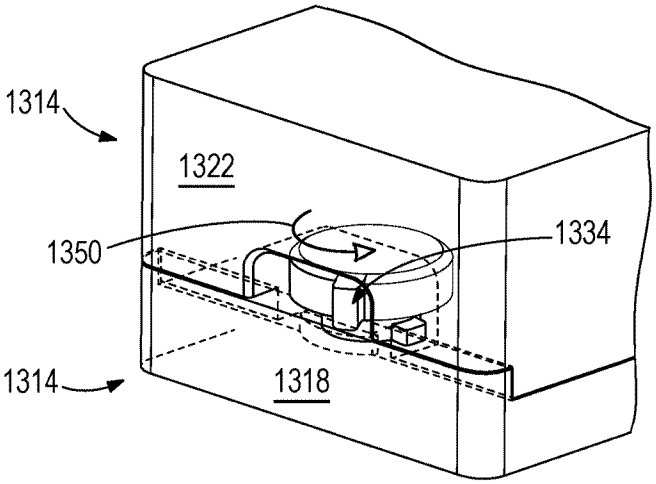
FIGS. 23A-23C are perspective views of the storage system of FIG. 21 illustrating steps for removably coupling containers to one another.
Figure 23A:
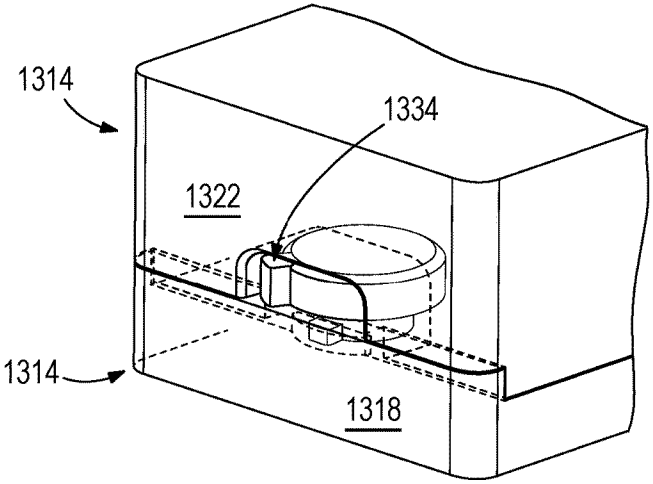
Figure 23C:
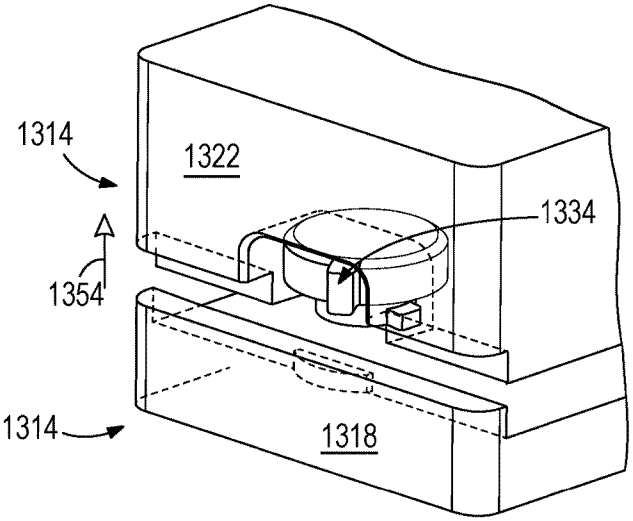

FIGS. 23A-C illustrate the steps of removing adjacent toolboxes 1314 from one another. FIG. 23A illustrates the latch 1342 in the locked position, which prevents the toolboxes 1314 from separating from one another. FIG. 23B illustrates the latch 1342 in the unlocked position, which results from a user rotating the actuator 1338 in the direction of arrow 1350. Such movement unlocks the toolboxes 1314 from another and allows the toolboxes 1314 to separate. Although the actuator 1338 is shown as being associated with rotational movement, those having skill in the art will appreciated that an actuator having non-rotational movement (e.g., translational sliding movement) may also be provided and is also contemplated herein. Solely moving the actuator 1338 as illustrated in FIG. 23B allows separation of adjacent toolboxes 1314 without forcing separation of adjacent toolboxes 1314. FIG. 23C illustrates separation of the toolboxes 1314 from one another completely in the direction of arrow 1354.

The steps shown in FIGS. 23A-C may take place in any order, and do not need to be initiated or completed in numerical order. For example, a user may initiate the step illustrated in FIG. 23B but does not need to remove the toolboxes 1314 from one another completely. In another embodiment, the latch 1342 and/or actuator 1338 include a ramped part to bias the latch 1342 and/or actuator 1338 into the locked position such that a user does not need to independently manipulate the actuator 1338 to lock adjacent toolboxes 1314 to one another. For example, when stacking adjacent toolboxes 1314, a user would only be required to reverse the actions illustrated in FIG. 23C by pressing toolboxes 1314 together in a direction opposite the arrow 1354, thereby urging the latch 1342 to the locked position and locking the adjacent toolboxes 1314 together.

Figure 24:
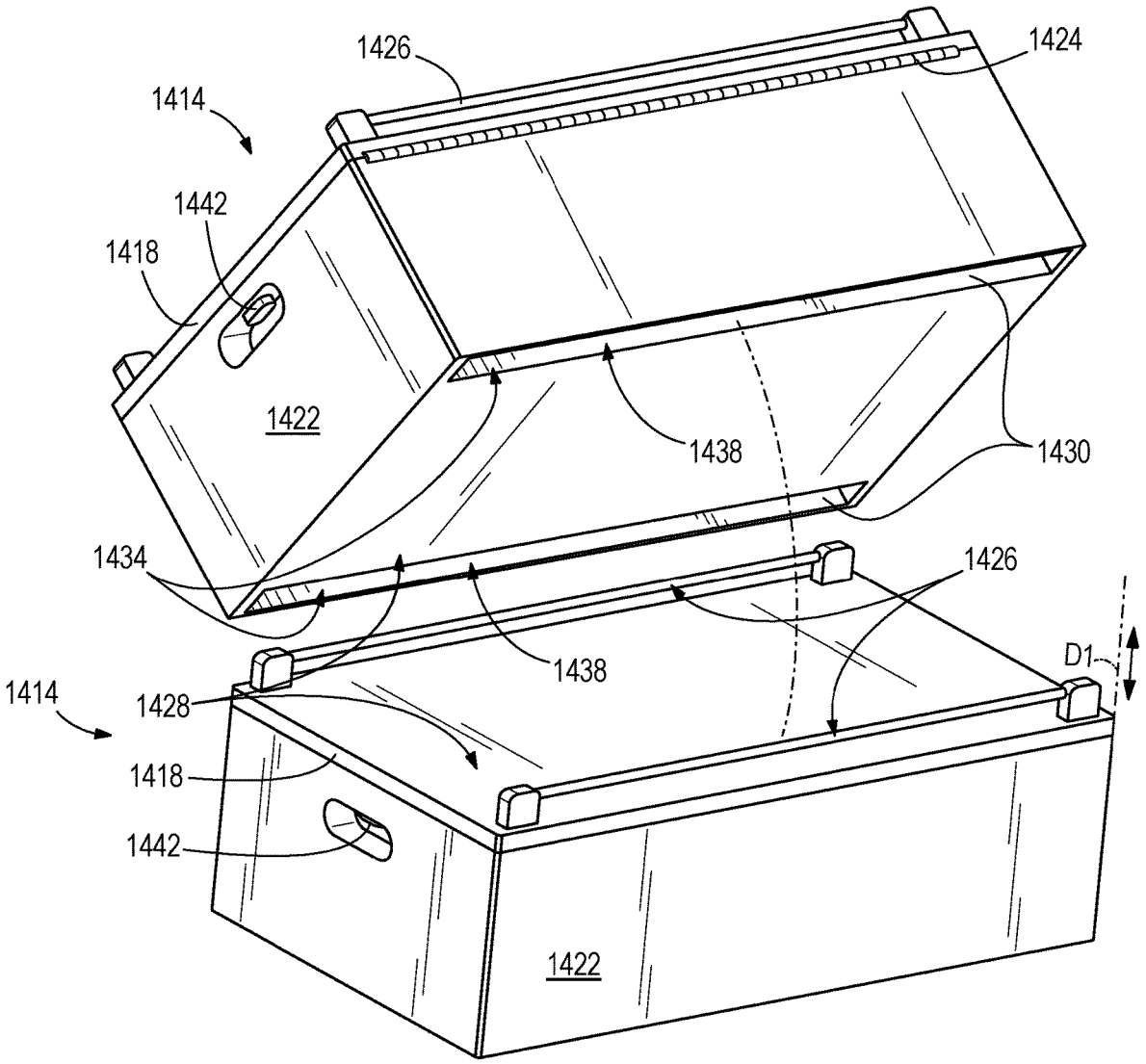
FIG. 24 is a perspective view of a storage system according to another embodiment.
Figure 25:
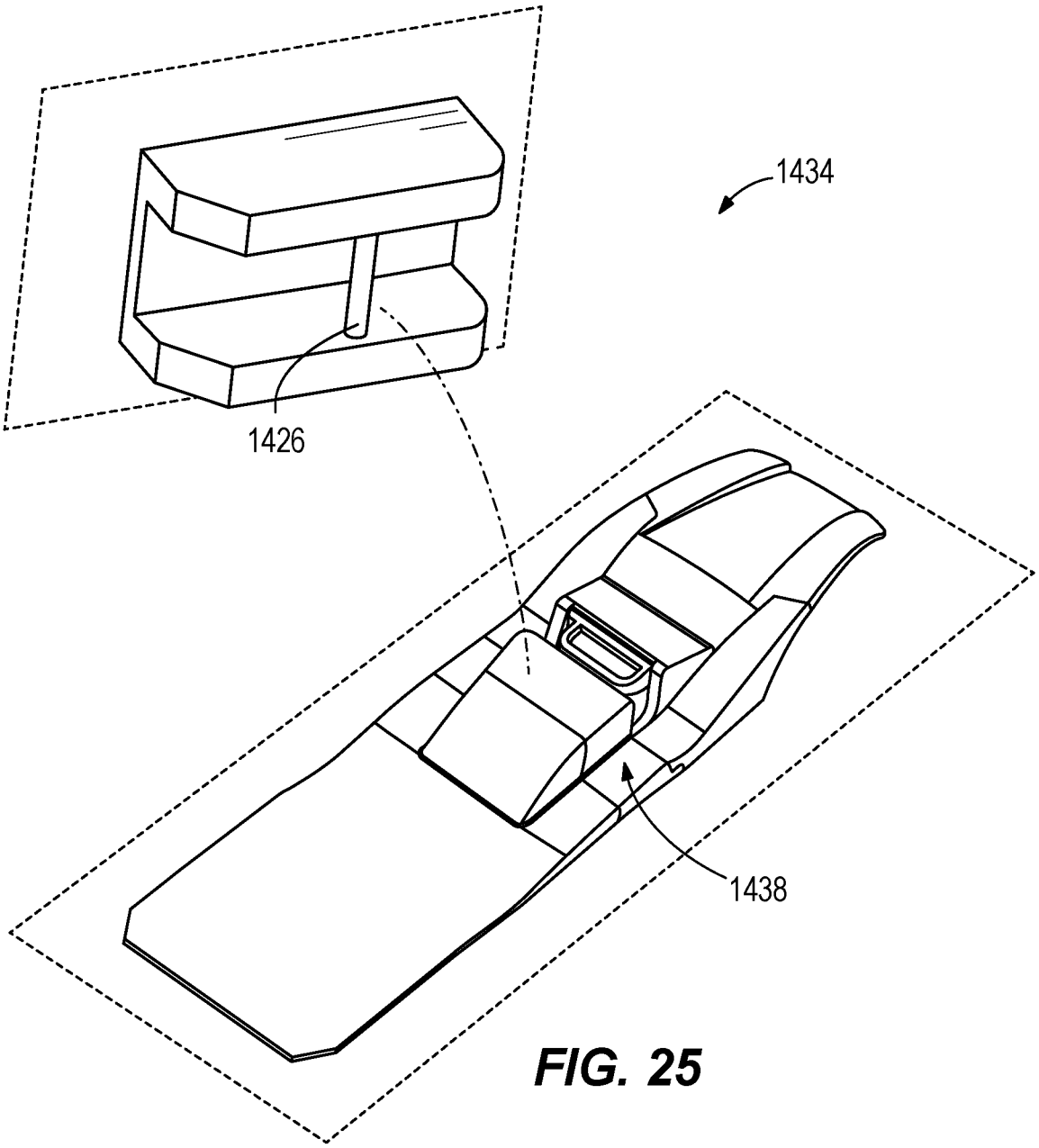
FIG. 25 is a perspective view of a coupling assembly of the storage system of FIG. 24.

FIGS. 24 and 25 illustrate a storage system 1410 according to another embodiment. The storage system 1410 includes at least two storage containers 1414 (e.g., toolboxes, etc.) stackable and securable to one another. Each of the toolboxes 1414 includes a base 1422 and a lid 1418 pivotally coupled to the base 1422 by a hinge 1424. The lid 1418 and base 1422 are selectively moved between an open position and a closed latched position. The system 1410 further includes an interface 1428 for mating complementary surfaces of the storage containers 1414 relative to one another.

The lid 1418 of one toolbox 1414 includes at least one bar or beam 1426 configured to fit into at least one slot 1430 within the base 1422 of another toolbox 1414. In the illustrated embodiment, the lid 1418 includes two beams 1426, and the base 1422 includes two slots 1430. In another embodiment, toolboxes 1414 include a larger number of beams 1426 and slots 1430. The toolboxes 1414 are stackable on one another such that the beams 1426 are inserted into the slots 1430.

Each of the toolboxes 1414 include a coupling assembly 1434 disposed at least partially within a slot 1434 for selectively coupling the toolboxes 1414 to one another at the interface 1428. The coupling assembly 1434 includes multiple latches 1438 for locking the beams 1426 within the slots 1430. The latches 1438 may be spring loaded such that the beams 1426 are press or snap fitted into the latches 1438. Once the beams 1426 are pressed into the latches 1438 within the slots 1430, the latches 1438 snap into a locked position to lock the toolboxes 1414 together.

FIG. 25 illustrates an exemplary embodiment of the coupling assembly 1434. In such exemplary embodiment, the coupling assembly 1434 includes the beams 1426 and latches 1438 that form a binding apparatus. The base 1422 further includes at least one release button 1442 to selectively open, unlock, or un-snap the latches 1438. In other words, when the release button 1442 is pressed, the latches 1438 move into an unlocked position, and the toolboxes 1414 may be separated from one another. The toolbox storage system 1410 may also include a variety of toolboxes 1446 having different capacities and sizes while each toolbox 1446 in the variety of toolboxes 1446 maintains the interface 1428.

Although aspects have been described in detail with reference to certain embodiments, variations and modifications exist within the scope and spirit of one or more independent aspects as described.

What is claimed is:

1. A stackable storage system comprising:

a first container including a projection extending away from the first container along a stacking direction, and an edge portion extending from the projection along a plane substantially perpendicular to the stacking direction;

a second container including a recess extending in a direction parallel to the stacking direction, the recess receives the projection when the first container and the second container are stacked relative to one another in the stacking direction; and a latch moveable between a first position and a second position, the latch overlapping the edge portion with respect to the stacking direction while the latch is in the first position to secure the first container and the second container to one another, the latch and edge portion positioned in a non-overlapping manner relative to one another with respect to the stacking direction while the latch is in the second position to permit separation of the first container from the second container, wherein the latch is oriented in a plane substantially perpendicular to the stacking direction.

2. The stackable storage system of claim 1, wherein relative movement in a direction normal to the stacking direction between the first container and the second container is prohibited while the first container and the second container are stacked along the stacking direction.

3. The stackable storage system of claim 1, wherein the latch is moveable in a direction that is different from the stacking direction.

4. The stackable storage system of claim 1, wherein the edge portion is a first edge portion, wherein the projection has a second edge portion extending along the plane substantially perpendicular to the stacking direction, and wherein the first edge portion and second edge portion extend from the projection in different directions.

5. The stackable storage system of claim 4, wherein the first edge portion is oriented at a first oblique angle relative to a front surface of the first container, and the second edge portion is oriented at a second oblique angle relative to the front surface of the first container.

6. The stackable storage system of claim 5, wherein the latch overlaps the first edge portion and the second edge portion along the stacking direction while in the first position.

7. The stackable storage system of claim 1, wherein the projection is a first projection in a plurality of projections each extending away from the first container along the stacking direction and having the edge portion extending along the plane substantially perpendicular to the stacking direction.

8. The stackable storage system of claim 7, wherein the latch overlaps the edge portion of each projection in the plurality of projections with respect to the stacking direction while in the first position.

9. The stackable storage system of claim 1, wherein one of the first container and the second container further includes a tab, and the other one of the first container and the second container further includes a notch, and wherein the tab and the notch are complimentary to one another and configured to align the first container with the second container in a common orientation when the first container and the second container are stacked on one another in the stacking direction.

10. The stackable storage system of claim 1 further comprising:

a biasing member; and a link moveably supported on either of the first container and the second container, the link configured to physically communicate movement to the latch, wherein either of the link and the latch are configured to receive a biasing force generated by the biasing member.

11. The stackable storage system of claim 10, wherein the link is a push button configured to be pressed by a user to move the latch from the first position to the second position, and wherein the biasing member is configured to urge the latch from the second position to the first position.

12. The stackable storage system of claim 10, wherein the link is a handle configured to be operated by a user to move the latch from the first position to the second position, and wherein the biasing member is configured to urge the latch from the second position to the first position.

13. A stackable storage system comprising:

a first container including a first surface, the first surface defining a first coupling portion;

a second container including a second surface opposite the first surface, the second surface defining a second coupling portion, the second coupling portion aligned with the first coupling portion; and a coupler disposed between the first coupling portion and the second coupling portion, the coupler configured to move between portions of the first coupling portion and the second coupling portion to selectively lock the first container to the second container, wherein the coupler comprises a locking plate having a longest direction oriented in a plane parallel to the first surface.

14. The stackable storage system of claim 13, wherein the first container and the second container are toolboxes.

15. The stackable storage system of claim 13, wherein the first container is stacked over the second container such that the first coupling portion is disposed around a perimeter of the second coupling portion.

16. The stackable storage system of claim 13, wherein the second coupling portion is configured to be at least partially nested with the first coupling portion.

17. The stackable storage system of claim 16, wherein the second coupling portion is a projection, and wherein the first coupling portion is a recess.

18. The stackable storage system of claim 13, wherein the coupler is spring biased towards a center of the first coupling portion, the second coupling portion, the first container, or the second container.

19. The stackable storage system of claim 13, wherein the coupler is movably attached to at least one of the first container and the second container.

20. The stackable storage system of claim 13, wherein the coupler is configured to slide through an opening formed in the first coupling portion to engage the second coupling portion thereby locking the first container to the second container.

21. The stackable storage system of claim 13, wherein the first container and the second container are prevented from shifting laterally with respect to a stacking direction.

22. The stackable storage system of claim 13, wherein the first coupling portion includes a plurality of recesses and the second coupling portion includes a plurality of projections, each of the projections engageable with an associated one of the recesses.

23. The stackable storage system of claim 22, wherein the coupler is a unitary member being positioned between each of the projections and the associated recesses.

* * * * *